US011725873B2

(12) United States Patent
Yu et al.

(10) Patent No.: US 11,725,873 B2
(45) **Date of Patent: *Aug. 15, 2023**

(54) REFRIGERATOR

(71) Applicant: LG Electronics Inc., Seoul (KR)

(72) Inventors: Seonil Yu, Seoul (KR); Hongsik Kwon, Seoul (KR); Junyi Heo, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/686,781

(22) Filed: Mar. 4, 2022

(65) Prior Publication Data

US 2022/0260307 A1 Aug. 18, 2022

Related U.S. Application Data

(63) Continuation of application No. 17/200,319, filed on Mar. 12, 2021, now Pat. No. 11,287,179, which is a (Continued)

(30) Foreign Application Priority Data

Oct. 31, 2014 (KR) ..... 10-2014-0150145

(51) Int. Cl.
*F25D 25/02* (2006.01)
*F25D 23/02* (2006.01)

(Continued)

(52) U.S. Cl.
CPC ..... *F25D 25/02* (2013.01); *A47B 96/16* (2013.01); *F25D 23/02* (2013.01); *F25D 25/024* (2013.01);

(Continued)

(58) Field of Classification Search
CPC ..... F25D 23/021; F25D 23/02; F25D 23/028; F25D 23/067; F25D 25/025;

(Continued)

(56) References Cited

U.S. PATENT DOCUMENTS 1,589,306 A * 6/1926 Masellus ..... F25D 25/02 312/331
1,835,847 A * 12/1931 Chandler ..... F25D 25/02 211/74

(Continued)

FOREIGN PATENT DOCUMENTS

CN 201036409 3/2008
EP 2218992 8/2010

(Continued)

OTHER PUBLICATIONS

Extended European Search Report in European Appln. No. 15855609.2, dated Feb. 14, 2019, 8 pages.

(Continued)

*Primary Examiner* — Kimberley S Wright
(74) *Attorney, Agent, or Firm* — Fish & Richardson P.C.

(57) ABSTRACT

A refrigerator with a drawer provided in a storage compartment formed on a cabinet and which accommodates stored goods, the drawer being movably supported by a drawer guide disposed in the storage compartment. A frame which is movable in the front/back directions by a frame guide, and a door opening and closing the storage compartment may be connected with the frame by a link. The frame may have a base part which is disposed on the lower side of the drawer and is connected with the link. The side plate includes a vertical part which is vertical with respect to the base part. A cross section formed by horizontally cutting the vertical part may be formed so as to be elongated along the moving direction of the drawer. The vertical part may be connected with the drawer so as to enable the drawer to move integrally with the frame.

16 Claims, 31 Drawing Sheets

Related U.S. Application Data continuation of application No. 16/546,970, filed on Aug. 21, 2019, now Pat. No. 10,969,160, which is a continuation of application No. 16/285,722, filed on Feb. 26, 2019, now Pat. No. 10,508,858, which is a continuation of application No. 15/523,420, filed as application No. PCT/KR2015/011666 on Nov. 2, 2015, now Pat. No. 10,240,857.

(51) Int. Cl.

| | |
|---|---|
| ***A47B 96/16*** | (2006.01) |
| *F25D 23/06* | (2006.01) |
| *A47B 88/417* | (2017.01) |
| *F25D 27/00* | (2006.01) |
| *F25D 23/00* | (2006.01) |

(52) U.S. Cl.

CPC ..... *F25D 25/025* (2013.01); *A47B 88/417* (2017.01); *F25D 23/00* (2013.01); *F25D 23/028* (2013.01); *F25D 23/06* (2013.01); *F25D 23/062* (2013.01); *F25D 23/067* (2013.01); *F25D 27/00* (2013.01); *F25D 2400/40* (2013.01)

(58) Field of Classification Search

CPC ..... F25D 25/024; F25D 23/062; F25D 25/02; A47B 96/16; A47B 88/417

See application file for complete search history.

(56) References Cited

U.S. PATENT DOCUMENTS

| | | | | |
|---|---|---|---|---|
| 1,899,171 | A | 2/1933 | Warren | |
| 2,780,926 | A * | 2/1957 | Sharpe | F25D 25/024 312/301 |
| 2,795,117 | A | 6/1957 | Herndon et al. | |
| 5,209,555 | A | 5/1993 | Camilleri | |
| 5,299,863 | A | 4/1994 | Albright, Jr. | |
| 6,378,969 | B1 | 4/2002 | Ferrari et al. | |
| 7,766,437 | B2 | 8/2010 | Lim et al. | |
| 8,002,369 | B2 | 8/2011 | Bello | |
| 8,333,446 | B2 | 12/2012 | Kang | |
| 8,950,836 | B2 | 2/2015 | Kim et al. | |
| 9,217,602 | B2 | 12/2015 | Lee et al. | |
| 9,726,423 | B1 | 8/2017 | Swamkar | |
| 9,897,371 | B2 | 2/2018 | Yang et al. | |
| 9,909,800 | B2 | 3/2018 | Jung | |
| 9,933,201 | B2 | 4/2018 | Yi et al. | |
| 9,939,192 | B2 | 4/2018 | Yang et al. | |
| 10,240,857 | B2 * | 3/2019 | Yu | F25D 25/024 |
| 10,508,858 | B2 * | 12/2019 | Yu | F25D 23/028 |
| 10,969,160 | B2 * | 4/2021 | Yu | F25D 23/067 |
| 11,287,179 | B2 * | 3/2022 | Yu | A47B 96/16 |
| 2010/0307186 | A1 | 12/2010 | Kwon et al. | |
| 2013/0147337 | A1 | 6/2013 | Lim | |
| 2013/0257255 | A1 | 10/2013 | Hwang et al. | |
| 2014/0252937 | A1 | 9/2014 | Lee et al. | |
| 2014/0300264 | A1 | 10/2014 | Park et al. | |
| 2016/0018157 | A1 | 1/2016 | Dubina et al. | |
| 2017/0227279 | A1 | 8/2017 | Yang et al. | |
| 2017/0227280 | A1 | 8/2017 | Yang et al. | |
| 2017/0227281 | A1 | 8/2017 | Yang et al. | |
| 2017/0314846 | A1 * | 11/2017 | Yu | F25D 23/028 |
| 2017/0350642 | A1 | 12/2017 | Yang et al. | |
| 2018/0038632 | A1 | 2/2018 | Yang et al. | |
| 2019/0186813 | A1 * | 6/2019 | Yu | F25D 25/02 |
| 2020/0191473 | A1 * | 6/2020 | Yu | A47B 96/16 |
| 2021/0270518 | A1 * | 9/2021 | Yu | F25D 25/024 |
| 2022/0260307 | A1 * | 8/2022 | Yu | F25D 25/025 |
| 2022/0307763 | A1 * | 9/2022 | Yang | F25D 23/062 |

FOREIGN PATENT DOCUMENTS

| | | |
|---|---|---|
| EP | 2250929 | 5/2012 |
| EP | 2976971 | 1/2016 |
| JP | S62135084 | 8/1987 |
| JP | H03233281 | 10/1991 |
| JP | H0636432 | 5/1994 |
| JP | H06300432 | 10/1994 |
| JP | H11118343 | 4/1999 |
| JP | 2001201249 | 7/2001 |
| JP | 2002267342 | 9/2002 |
| JP | 2004000403 | 1/2004 |
| JP | 2004093039 | 3/2004 |
| JP | 2004101029 | 4/2004 |
| JP | 3112237 | 8/2005 |
| KR | 1020050118585 | 12/2005 |
| KR | 1020100032549 | 3/2010 |
| KR | 1020100130357 | 12/2010 |
| KR | 1020110080021 | 7/2011 |
| KR | 1020110121175 | 11/2011 |
| WO | 03065846 | 8/2003 |

OTHER PUBLICATIONS

International Search Report in International Application No. PCT/KR2015/011666, dated Nov. 2, 2015, 3 pages.

* cited by examiner

REFRIGERATOR

CROSS REFERENCE TO RELATED APPLICATIONS

This application is a continuation of Ser. No. 17/200,319, filed on Mar. 12, 2021, which is a continuation of U.S. application Ser. No. 16/546,970, filed on Aug. 21, 2019, now U.S. Pat. No. 10,969,160, which is a continuation of U.S. application Ser. No. 16/285,722, filed on Feb. 26, 2019, now U.S. Pat. No. 10,508,858, which is a continuation of U.S. application Ser. No. 15/523,420, filed on May 1, 2017, now U.S. Pat. No. 10,240,857, which claims benefit of International Application PCT/KR2015/011666, filed on Nov. 2, 2015, which claims the benefit of Korean Application No. 10-2014-0150145, filed on Oct. 31, 2014, the entire contents of which are hereby incorporated by reference in their entireties.

TECHNICAL FIELD

The present invention relates to a refrigerator.

BACKGROUND ART

A refrigerator is an electric home appliance that is used to store food in a refrigerated state or in a frozen state.

In recent years, the capacity of the refrigerator has been greatly increased, and a home bar, an ice maker, a shelf, or a door box has been mounted on the rear of a door of the refrigerator. In this type of refrigerator, when the door of the refrigerator is closed, the component mounted on the rear of the door of the refrigerator may interfere with a shelf or a drawer mounted in a storage compartment of a main body of the refrigerator.

In order to prevent such interference, the front end of a food storage unit (e.g. a shelf or a drawer) mounted in the storage compartment of the main body of the refrigerator, i.e. a refrigerating compartment or a freezing compartment, is located at a place spaced apart from the front of the main body of the refrigerator by a predetermined distance.

For this reason, a user must put his/her hand into the storage compartment deeply in order to take out food stored in the food storage unit. Furthermore, it is difficult for the user to check the food stored in the rear portion of the storage compartment. These problems become more critical as the size of the refrigerator is increased.

Various methods have been proposed to solve the above problems. In particular, Korean Patent Application Publication No. 2010-0130357 (hereinafter, referred to as '357 patent), which was filed in the name of the applicant of the present application, discloses a refrigerator configured to have a structure in which a shelf or a drawer mounted in a refrigerating compartment or a freezing compartment is disposed at a receiving frame, the front end of an articulated link is connected to the bottom surface of a refrigerator door, and the rear end of the articulated link is connected to the receiving frame. When the refrigerator door is turned and opened, therefore, the receiving frame is moved forward, with the result that the shelf or the drawer is moved forward.

In the refrigerator having the above structure, the entire load of the shelf or the drawer is transferred to the receiving frame. In other words, the load of the shelf or the drawer and the load of the food stored on the shelf or in the drawer are concentrated on the receiving frame. For this reason, it is important to design the receiving frame such that the receiving frame can sufficiently withstand the loads. As a result, the structure of the receiving frame is complicated, and the volume of the receiving frame is increased. Consequently, the weight of the receiving frame is increased. Furthermore, the capacity of the storage compartment is reduced due to the receiving frame.

In addition, in '357 patent, the link, which is interlocked with the door to move the receiving frame, is connected to the bottom surface of the receiving frame. Consequently, the force applied through the link acts on the bottom surface of the receiving frame. However, the center of gravity of the drawer is concentrated on the upper side of the bottom surface of the receiving frame. For this reason, the line of action of the force applied through the link and the line of action of the force applied due to the inertia of the drawer are not aligned with each other. Consequently, bending moment or shearing force acts on the receiving frame, with the result that the receiving frame may become deformed. This phenomenon becomes more serious as the weight of the food stored in the drawer is increased. In particular, in '357 patent, the load of the drawer accelerates deformation of the receiving frame together with the inertia of the drawer, since the load of the drawer is supported by the receiving frame.

In addition, in '357 patent, a rail mounted to the bottom surface of the frame must be maintained so as to be normally operated, since the load applied to the receiving frame is concentrated on the rail. In '357 patent, however, there are strong limitations in designing the rail in order to ensure that the rail has sufficient durability within predetermined standards.

In addition, in the structure in which the entire load applied to the receiving frame is concentrated on the rail, the receiving frame may easily shake during movement. If the rail or the receiving frame is deformed due to repetitive shaking of the receiving frame, the receiving frame is not moved stably.

Japanese Patent Application Publication No. JP2004-93039A (hereinafter, referred to as '039 patent) discloses a refrigerator configured to have a structure in which a shelf provided in a storage compartment is connected to a door via an arm such that the shelf is withdrawn by the arm when the door is opened. The arm is directly connected to the shelf. In order to simultaneously withdraw a plurality of shelves interlocked with the door, a plurality of arms is provided such that the arms are connected to the respective shelves.

In addition, the arms must be installed so as to correspond to the heights of the shelves, with the result that the positions at which the arms are installed are limited. In particular, a considerable portion of an arm connected to a shelf located at the middle of the storage compartment may be visible to a user.

In addition, in '357 patent and '039 patent, the structure of the receiving frame is exposed in the storage compartment. For this reason, the storage compartment does not have an aesthetically pleasing appearance. In addition, the storage space in the storage compartment is reduced due to the receiving frame, and the circulation of cool air in the storage compartment is disturbed by the receiving frame.

DISCLOSURE

Technical Problem

A first object of the present invention is to provide a refrigerator including a frame interlocked with a door for automatically withdrawing a drawer (i.e. moving the drawer in the forward direction) or returning the drawer (i.e. moving the drawer in the rearward direction), wherein the load of the drawer is supported by a drawer guide such that the frame can stably move the drawer supported by the drawer guide.

A second object of the present invention is to provide a refrigerator configured to have a structure in which the load applied to the frame guide, which supports the frame, is reduced, thereby guaranteeing smooth motion of the frame.

A third object of the present invention is to provide a refrigerator configured to have a structure in which the frame includes a vertical part having a horizontal section extending in the forward-rearward direction such that the frame exhibits sufficient rigidity to withstand the repulsive force applied to the drawer.

A fourth object of the present invention is to provide a refrigerator configured to have a structure in which a side plate constituting the frame is mounted in the space between an inner cabinet and an outer cabinet.

A fifth object of the present invention is to provide a refrigerator configured to have a structure in which a base part interlocked with the door via a link is disposed inside a storage compartment, the side plate includes a horizontal part configured to extend through a frame guide slit formed in the inner cabinet and a vertical part extending upward from the horizontal part so as to be disposed between the inner cabinet and the outer cabinet, and the horizontal part is connected to the base part in the storage compartment.

A sixth object of the present invention is to provide a refrigerator configured to have a structure in which a user manipulates an interlocking unit to select a drawer to be automatically withdrawn in response to the opening and closing operation of the door.

A seventh object of the present invention is to provide a refrigerator configured to have a structure in which electric power is supplied to an electric part, such as a lighting device, mounted at the drawer through the interlocking unit.

An eighth object of the present invention is to provide a refrigerator configured to have a structure in which the forward-rearward length of the side plate constituting the frame is shorter than the length of the side edge of the base part, whereby the length of the frame guide slit, through which the side plate extends, is also reduced.

A ninth object of the present invention is to provide a refrigerator configured to have a structure in which a connection mount protruding from the vertical part constituting the side plate is supported by an interlocking unit guide slit formed in the side wall of the inner cabinet.

A tenth object of the present invention is to provide a refrigerator configured to have a structure in which the interlocking unit can be installed and removed in the storage compartment.

An eleventh object of the present invention is to provide a refrigerator configured to have a structure in which the load of portions of the drawers disposed in the storage compartment is supported by the drawer guide, and the load of other portions of the drawers is supported by the base part constituting the frame.

A twelfth object of the present invention is to provide a refrigerator having a lighting device mounted at the drawer (e.g. a shelf).

A thirteenth object of the present invention is to provide a refrigerator configured to have a structure in which electric power is supplied to an electric part, such as a lighting device, mounted at the drawer through the interlocking unit.

Technical Solution

A refrigerator according to the present invention may be configured such that a drawer for storing food in a storage compartment defined in a cabinet is movably supported by a drawer guide disposed in the storage compartment. A frame supported by a frame guide so as to be movable in the forward-rearward direction may be provided in the storage compartment. A door for opening and closing the storage compartment may be connected to the frame via a link. The frame may include a base part disposed at the lower side of the drawer, the base part being connected to the link, and a side plate extending from the base part so as to extend to a height corresponding to the drawer.

The side plate may include a vertical part perpendicular to the base part. The horizontal section of the vertical part may extend in the direction in which the drawer is moved. The vertical part may be connected to the drawer such that the drawer can be moved together with the frame.

The frame and the drawer, which are connected to each other via the interlocking unit, may be simultaneously moved in the state in which the load of the drawer is supported by the drawer guide. Since the load of the drawer supported by the drawer guide is not applied to the vertical part, the structure for supporting the load of the drawer and the structure for moving the drawer may be separated from each other.

The frame connected to the door via the link is moved in response to the opening and closing operation of the door. The frame includes a base part connected to the link and a side plate extending upward from the base part so as to be connected to the drawer. When the link is operated in response to the opening and closing operation of the door, therefore, the side plate is moved together with the base part, and the drawer connected to the side plate is also moved. The horizontal section of the portion of the side plate that extends upward from the base part extends in the direction in which the drawer is moved. Consequently, the side plate may be more able to withstand the repulsive force from the drawer.

A refrigerator according to an embodiment of the present invention may include a cabinet having a storage compartment defined by a front surface having an opening therein, a pair of side surfaces extending rearward from the front surface while facing each other, an upper surface interconnecting upper ends of the side surfaces, a bottom surface interconnecting lower ends of the side surfaces while facing the upper surface, and a rear surface interconnecting the side surfaces, the upper surface, and the bottom surface while facing the opening.

The cabinet may include an inner cabinet, having therein a storage compartment defined by a front surface having an opening, a pair of side surfaces extending rearward from the front surface while facing each other, an upper surface interconnecting upper ends of the side surfaces, a bottom surface interconnecting lower ends of the side surfaces while facing the upper surface, and a rear surface interconnecting the side surfaces, the upper surface, and the bottom surface while facing the opening.

The cabinet may include an outer cabinet disposed outside the inner cabinet to form a predetermined space between the outer cabinet and the inner cabinet.

The inner cabinet may be provided in a side surface thereof with a frame guide slit horizontally extending in the forward-rearward direction and an interlocking unit guide slit extending parallel to the frame guide slit above the frame guide slit.

The refrigerator may include a door hinged to the cabinet for opening and closing the opening.

The refrigerator may include a drawer disposed in the storage compartment for storing goods.

The refrigerator may include a cantilever disposed in the storage compartment, the rear end of the cantilever being coupled to the rear surface of the storage compartment, the cantilever extending horizontally from the rear end thereof toward the opening.

The drawer may be supported by the cantilever and may be disposed so as to be movable in the longitudinal direction of the cantilever.

The drawer may include a plurality of drawers arranged in the upward-downward direction, and the cantilever may include a plurality of cantilevers arranged in the upward-downward direction for supporting the drawers.

The cantilever may be disposed at the lower side of the drawer to support the bottom surface of the drawer.

The drawer may be provided in the bottom surface thereof with a groove extending in the longitudinal direction of the cantilever, the groove being guided along the upper end of the cantilever during the movement of the drawer.

The storage compartment may be provided in the rear surface thereof with a plurality of slots, into which the rear end of the cantilever is separably coupled, the slots being arranged in the upward-downward direction.

The refrigerator may include a base part disposed at the lower side of the drawer and a side plate extending from the base part toward the upper surface of the storage compartment. The side plate may include a vertical part disposed between the cantilever and a side surface of the storage compartment. The vertical part may extend up to at least a height corresponding to the drawer, and may have a horizontal section extending in the forward-rearward direction.

The base part may include a horizontal plate disposed horizontally at the lower side of the drawer and connected to the rear end of the link.

The refrigerator may include a frame guide disposed between the storage compartment and the base part for supporting the base part such that the base part is movable in the forward-rearward direction.

The refrigerator may include a link, having a front end turnably connected to the door and a rear end turnably connected to the base part, for moving the base part in response to turning of the door.

The refrigerator may include an interlocking unit for connecting the drawer to the vertical part such that the drawer is interlocked with the frame.

The side plate may further include a horizontal part for interconnecting the base part and the vertical part, the horizontal part being formed in a horizontal plate shape. The horizontal part and the vertical part of the side plate may be formed by bending a single plate.

The vertical part may include a vertical extension section extending from the horizontal part and a horizontal protrusion section protruding forward from the vertical extension section by a predetermined length.

The horizontal protrusion section may include a plurality of horizontal protrusion sections formed at different heights.

The horizontal protrusion sections may be formed at heights corresponding to the cantilevers.

The horizontal part may be connected to the horizontal plate.

The vertical part may be configured such that the forward-rearward length of the horizontal section is shorter than the length of the side edge of the horizontal plate.

The base part may include a pair of support walls extending upward from opposite sides of the horizontal plate. The refrigerator may further include a drawer supported by the support walls.

The drawer supported by the support walls may be provided with rollers, and the support walls may be provided with stationary rails extending in the forward-rearward direction for supporting the rollers.

The rear end of the link may be connected to the bottom surface of the horizontal plate.

The horizontal part may be connected to the bottom surface of the horizontal plate.

The frame guide may be disposed between the bottom surface of the storage compartment and the horizontal plate.

The vertical part may be provided with a protrusion fastening hole. The interlocking unit may include a connection protrusion disposed on the drawer so as to be movable in the lateral direction, the connection protrusion being inserted into or separated from the protrusion fastening hole depending on the position of the connection protrusion after the movement thereof.

The connection protrusion may be inserted into the protrusion fastening hole when the connection protrusion is moved toward a side surface of the storage compartment. The connection protrusion may be separated from the protrusion fastening hole when the connection protrusion is moved away from a side surface of the storage compartment.

The drawer may include a plurality of drawers arranged in the upward-downward direction, and the protrusion fastening hole may include a plurality of protrusion fastening holes formed at heights corresponding to the drawers.

The drawer may be provided in a side surface thereof with a protrusion fastening hole. The interlocking unit may include a connection protrusion disposed on the vertical part so as to be movable in a lateral direction, the connection protrusion being inserted into or separated from the protrusion fastening hole depending on the position of the connection protrusion after the movement thereof.

The interlocking unit may include a connection mount protruding from the vertical part toward the drawer, a middle interlocking member disposed between a side surface of the storage compartment and the drawer so as to be coupled to the connection mount, and a slide interlocking member provided on the drawer so as to be movable in the lateral direction, the slide interlocking member being coupled to or separated from the middle interlocking member depending on the position of the slide interlocking member after the movement thereof.

The middle interlocking member may be provided with a coupling recess, into which the connection mount is inserted.

The connection mount may include a plurality of connection mounts arranged in the upward-downward direction, and the coupling recess may include a plurality of coupling recesses corresponding to the connection mounts.

The drawer may be provided with a holder for supporting the slide interlocking member so as to be movable in the lateral direction.

The holder may include a lower support plate for supporting the slide interlocking member from below, the lower support plate extending in the lateral direction, and a catching protrusion extending upward from the lower support plate, the catching protrusion being located at the rear of the slide interlocking member.

The middle interlocking member may be provided in the surface thereof opposite the drawer with an insertion recess, and the slide interlocking member may include a connection protrusion configured to be inserted into or separated from the insertion recess depending on the position of the slide interlocking member on the drawer.

The refrigerator may further include a guide protrusion protruding rearward from the drawer. The slide interlocking member may be provided in the front surface thereof opposite the drawer with a protrusion insertion recess, into which the guide protrusion is inserted, the protrusion insertion recess being formed in the direction in which the slide interlocking member is moved, the protrusion insertion recess being longer than the outer diameter of the guide protrusion.

The connection mount may be provided with a through hole, through which a power supply cable passes. The slide interlocking member may include an interlocking member housing supported by the lower support plate and a connection terminal protruding from the interlocking member housing toward a side surface of the storage compartment. The middle interlocking member may include a socket, into which the connection terminal is inserted. The power supply cable, after having passed through the through hole in the connection mount, may be guided to the socket such that the power supply cable is electrically connected to the connection terminal.

The middle interlocking member may be provided with a power supply cable guide recess for guiding the power supply cable to the socket.

The refrigerator may further include a guide protrusion protruding rearward from the drawer, the guide protrusion being formed in the shape of a pipe having a hollow part. An electric wire connected to the connection terminal may be connected to a lighting device provided at the drawer through the hollow part.

The refrigerator may include an extendable horizontal support bar disposed in the storage compartment for interconnecting the rear surface of the storage compartment and the drawer, the horizontal support bar being configured to support the drawer such that the drawer is located at a predetermined height in the storage compartment, the length of the horizontal support bar being variable so as to correspond to the distance between the rear surface of the storage compartment and the drawer.

The side plate may include a vertical part disposed between the horizontal support bar and a side surface of the storage compartment.

The horizontal support bar may include a stationary horizontal bar connected to the rear surface of the storage compartment and extending forward in the rear surface and a moving horizontal bar connected to the drawer and coupled to the stationary horizontal bar so as to extend in a longitudinal direction of the horizontal support bar.

The moving horizontal bar may be connected to the rear surface of the drawer opposite the rear surface of the storage compartment.

The side plate may be disposed between a side surface of the storage compartment and the horizontal support bar.

The refrigerator may include a drawer guide disposed at a side surface of the storage compartment for guiding the drawer so as to be movable in the forward-rearward direction.

The side plate may include a vertical part disposed between the drawer guide and the rear surface of the storage compartment.

The vertical part may be moved between the drawer guide and the rear surface of the storage compartment when the door is turned.

The drawer guide may include a stationary rail fixed to a side surface of the storage compartment and extending in the forward-rearward direction and a moving rail fixed to the drawer so as to be slidable along the stationary rail.

The interlocking unit may be disposed at the rear of the moving rail.

The refrigerator may include a horizontal plate disposed at the lower side of the drawer in the storage compartment and a vertical part disposed between the side wall of the inner cabinet, which defines a side surface of the storage compartment, and the outer cabinet, the vertical part being connected to the horizontal plate through the frame guide slit. The vertical part may extend up to at least a height corresponding to the drawer, and may have a horizontal section extending in the forward-rearward direction.

The refrigerator may include a frame guide disposed between the inner cabinet and the storage compartment for supporting the horizontal plate such that the horizontal plate is movable in the forward-rearward direction.

The refrigerator may include a link, having a front end turnably connected to the door and a rear end turnably connected to the horizontal plate, for moving the horizontal plate in response to turning of the door.

The refrigerator may further include a horizontal part for interconnecting the horizontal plate and the vertical part through the frame guide slit, the horizontal part being formed in a horizontal plate shape.

The refrigerator may include a horizontal plate disposed at the lower side of the drawer and a side plate connected to the horizontal plate. The side plate may include a vertical part perpendicular to the horizontal plate. The vertical part may extend up to at least a height corresponding to the drawer, and may have a horizontal section extending in the forward-rearward direction.

The interlocking unit may connect the drawer to the vertical part through the interlocking unit guide slit such that the drawer is interlocked with the frame.

Advantageous Effects

A refrigerator according to an embodiment of the present invention has the following effects.

First, the cantilever supports the load of the drawer, and the frame moves the drawer, which is supported by the cantilever, thereby preventing deformation of the frame. In particular, the horizontal section of the side plate constituting the frame extends in the direction in which the drawer is moved. Consequently, the frame is structurally stable even in the case in which the thickness of the frame is thin, and the frame effectively withstands the repulsive force from the drawer.

Second, the frame is configured to automatically withdraw the drawer. The side plate constituting the frame is disposed in the space between the inner cabinet and the outer cabinet, thereby minimizing the portion of the side plate that is visible to a user. In addition, the volume of the frame in the storage compartment is reduced, thereby minimizing the reduction in capacity of the storage compartment resulting from installation of the frame.

Third, the frame is configured such that the base part connected to the link is disposed in the storage compartment and that the side plate configured to move simultaneously with the base part is connected to the horizontal plate through the frame guide slit, which is formed in the inner cabinet. In particular, the side plate may include a horizontal part configured to extend through the frame guide slit and a vertical part extending upward from the horizontal part so as to be disposed between the inner cabinet and the outer cabinet. The horizontal plate, which is disposed in the storage compartment, is connected to the vertical part, which is disposed outside the storage compartment (i.e. the space between the inner cabinet and the outer cabinet), via the horizontal part. In this structure, the side plate is disposed outside the inner cabinet, the horizontal part constituting the side plate is inserted into the storage compartment through the frame guide, and the horizontal part is connected to the base part, which is located in the storage compartment. Consequently, the frame is installed and removed through a simple procedure.

Fourth, the interlocking unit, which interlocks the drawer with the frame, is selectively coupled to or separated from the frame. Consequently, it is possible for the user to select a drawer to be automatically withdrawn in response to the opening and closing operation of the door.

Fifth, the interlocking unit not only interlocks the drawer with the frame but also supplies electric power. Consequently, it is possible to supply electric lower to the electric part, such as a lighting device, mounted at the drawer through the interlocking unit.

Sixth, the load of the drawer supported by the drawer guide is not applied to the frame, and the frame only moves the drawer supported by the drawer guide. Consequently, the side plate may be mounted at one side of the base part. In a side-by-side or four-door type refrigerator configured to have a structure in which one compartment is horizontally divided into two storage compartments, the drawer is automatically withdrawn even in the case in which the side plate is mounted only at one side of the drawer without a side plate mounted at the boundary of the two storage compartments (i.e. in the middle of the compartment). In this case, the portion of the frame exposed to the inside of the storage compartment is reduced, thereby minimizing the hindrance of circulation of cool air due to the frame.

Seventh, the thickness of the side plate constituting the frame may be reduced, since the load of the drawer supported by the drawer guide is not applied to the frame. In addition, it is sufficient for the side plate to have a forward-rearward length at which the side plate can withstand repulsive force resulting from the inertia of the drawer. Consequently, the forward-rearward length of the side plate may be shorter than the forward-rearward length of the base part. In this case, the entire load of the frame is reduced, whereby the frame is moved more smoothly. In addition, the length of the frame guide slit, through which the side plate extends, may be reduced, thereby reducing the amount of cool air that leaks through the frame guide slit.

Eighth, the connection mount, which protrudes from the vertical part constituting the side plate, may be guided through the interlocking unit guide slit, which is formed in the side wall of the inner cabinet. In this case, the shaking of the side plate may be reduced during the movement of the frame.

Ninth, the interlocking unit is installed and removed in the storage compartment. Consequently, it is possible to easily install, remove, or maintain the interlocking unit without disassembling the refrigerator.

Tenth, in the case in which a plurality of drawers is disposed in the storage compartment, the drawers are moved in the state of being connected to respective side plates. Consequently, the distances by which the drawers are withdrawn in response to the opening operation of the door are uniform. In particular, the drawers may be aligned in the upward-downward direction in the state in which the door is fully open.

DESCRIPTION OF DRAWINGS

FIGS. 4A and 4B are a side view showing the refrigerator of FIG. 3, wherein FIG. 4A shows the state in which a door is closed and FIG. 4B shows the state in which the door is open;

FIGS. 5A and 5B are a side view showing a refrigerator according to a second embodiment of the present invention, wherein FIG. 5A shows the state in which a door is closed and FIG. 5B shows the state in which the door is open;

FIGS. 7A and 7B are a side view showing the refrigerator of FIG. 6, wherein FIG. 7A shows the state in which a door is closed and FIG. 7B shows the state in which the door is open;

FIGS. 9A and 9B are a side view showing a refrigerator according to a fifth embodiment of the present invention, wherein FIG. 9A shows the state in which a door is closed and FIG. 9B shows the state in which the door is open;

FIGS. 18A and 18B are a view showing the middle interlocking member, wherein FIG. 18A is a front view of the middle interlocking member and FIG. 18B is a rear view of the middle interlocking member;

BEST MODE

The advantages and features of the present invention and methods for achieving them will be more clearly understood from the following detailed description taken in conjunction with the accompanying drawings. However, the present invention may be embodied in many different forms and should not be construed as limited to the embodiments set forth herein. Rather, these embodiments are provided so that the present invention will be thorough and complete, and will fully convey the scope of the invention to those skilled in the art. The present invention is defined only by the categories of the claims. Wherever possible, the same reference symbols will be used throughout the drawings to refer to the same or like parts.

Figure 1:
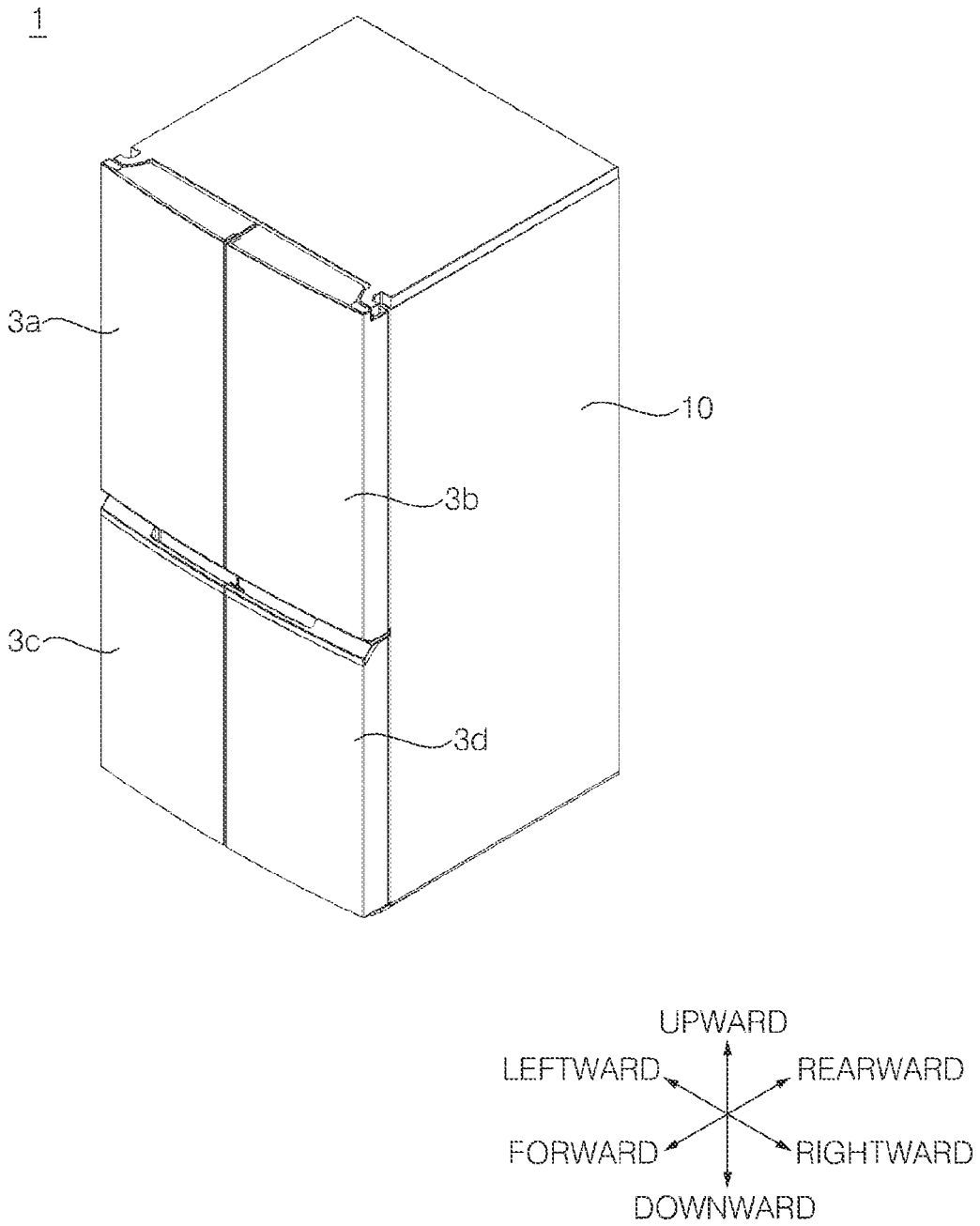
FIG. 1 is a perspective view showing the external appearance of a refrigerator that may be commonly applied to embodiments of the present invention.
Figure 2:
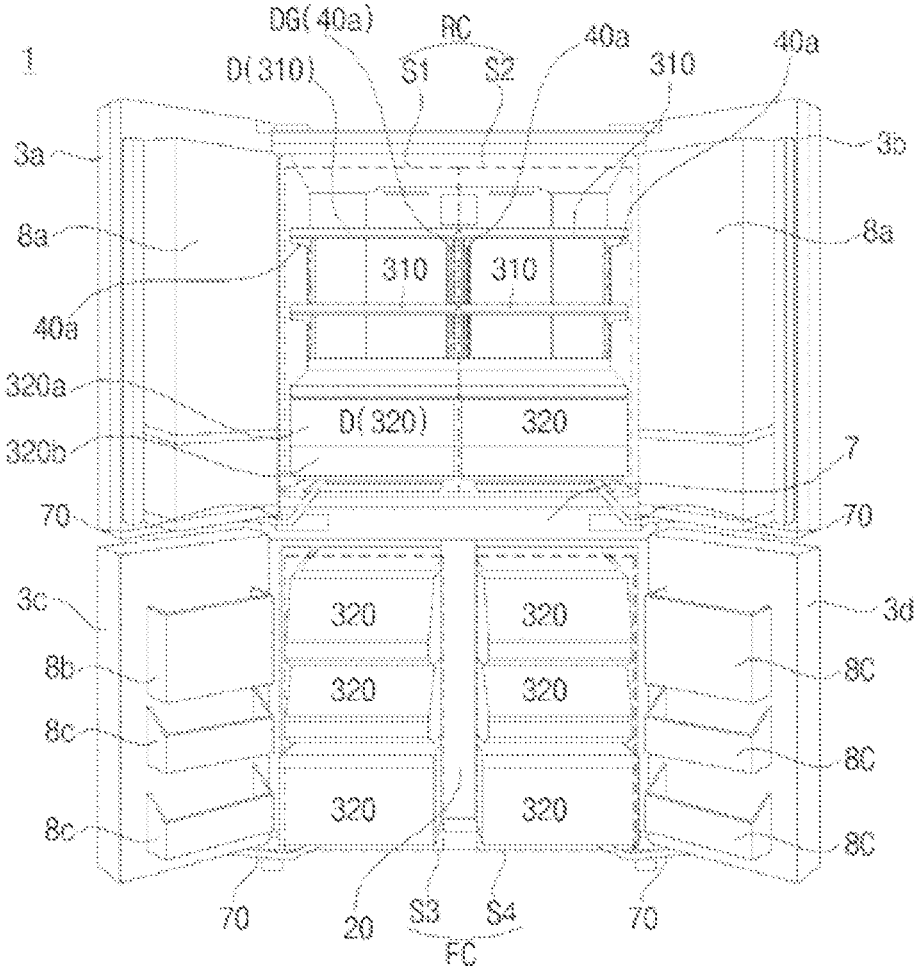
FIG. 2 is a view showing the state in which doors of the refrigerator of FIG. 1 are open.

FIG. 1 is a perspective view showing the external appearance of a refrigerator that may be commonly applied to embodiments of the present invention. FIG. 2 is a view showing the state in which doors of the refrigerator of FIG. 1 are open. The "forward"/"rearward"/"leftward"/"rightward"/"upward"/"downward" directions set forth herein are defined as shown in FIG. 1. However, these directions are used merely to clearly describe the present invention. Consequently, the above directions may be differently defined as needed.

Referring to FIGS. 1 and 2, a refrigerator 1 may include a cabinet 10 having compartments RC and FC or storage compartments S1, S2, S3, and S4 defined therein and doors 3*a*, 3*b*, 3*c*, and 3*d* hinged to the cabinet 10 for opening and closing the compartments RC and FC. The front surfaces of the compartments RC and FC are open. The open front surfaces of the compartments RC and FC may be opened and closed by the doors 3*a*, 3*b*, 3*c*, and 3*d*. Cool air is supplied into the compartments RC and FC. The compartments RC and FC may be sealed by the doors 3*a*, 3*b*, 3*c*, and 3*d* such that cool air does not leak from the compartments RC and FC.

Two or more compartments RC and FC may be provided. For a bottom freezer type refrigerator as in this embodiment, the cabinet 10 is partitioned into the upper part and the lower part by a horizontal partition 7, and the compartments RC and FC are provided in the upper part and the lower part of the cabinet 10, respectively. In this case, the lower compartment FC is a freezing compartment, the interior temperature of which is maintained below 0° C., and the upper compartment RC is a refrigerating compartment, the interior temperature of which is maintained above 0° C. In the following description, a "compartment" may be a refrigerating compartment or a freezing compartment, unless mentioned otherwise.

Each of the partitions RC and FC may be opened and closed by a pair of doors. For example, as in this embodiment, the refrigerating compartment RC may be opened and closed by a pair of refrigerating compartment doors 3*a* and 3*b*, and the freezing compartment FC may be opened and closed by a pair of freezing compartment doors 3*c* and 3*d*.

The storage compartments S1, S2, S3, and S4 constitute all or portions of the partitions RC and FC. The storage compartments S1, S2, S3, and S4 may be defined as regions that are opened and closed by the doors 3*a*, 3*b*, 3*c*, and 3*d*. The refrigerating compartment RC may include a storage compartment S1, the open front surface of which is opened and closed by a left refrigerating compartment door 3*a*, and a storage compartment S2, the open front surface of which is opened and closed by a right refrigerating compartment door 3*b*. Hereinafter, the storage compartment S1 may be referred to as a left refrigerating storage compartment and the storage compartment S2 may be referred to as a right refrigerating storage compartment as needed.

In the same manner, the freezing compartment FC may include a storage compartment S3, the open front surface of which is opened and closed by a left freezing compartment door 3*c*, and a storage compartment S4, the open front surface of which is opened and closed by a right freezing compartment door 3*d*. Hereinafter, the storage compartment S3 may be referred to as a left freezing storage compartment and the storage compartment S4 may be referred to as a right freezing storage compartment as needed.

In the case in which two storage compartments are provided in one compartment in the horizontal direction, as described above, the storage compartments may communicate with each other. When the refrigerating compartment RC is viewed from the front, the left refrigerating storage compartment S1 and the right refrigerating storage compartment S2 are not divided from each other. Consequently, cool air may freely flow between the left refrigerating storage compartment S1 and the right refrigerating storage compartment S2. In this case, the refrigerating compartment RC may be defined as a single storage compartment.

Unlike the refrigerating compartment RC, a vertical partition 20 is provided between the left freezing storage compartment S3 and the right freezing storage compartment S4 of the freezing compartment FC. As a result, the storage compartments S3 and S4 may be partitioned from each other. Even in this case, however, the flow of cool air between the storage compartments S3 and S4 may not be completely blocked. For example, the vertical partition 20 may be provided with through holes (not shown), through which the storage compartments S3 and S4 communicate with each other.

Each of the storage compartments S1, S2, S3, and S4 may be defined by a front surface having an opening therein, a pair of side surfaces extending rearward from the front surface while facing each other, an upper surface interconnecting the upper ends of the side surfaces, a bottom surface interconnecting the lower ends of the side surfaces while facing the upper surface, and a rear surface interconnecting the side surfaces, the upper surface, and the bottom surface while facing the opening.

According to the above definition, in the case in which one space is partitioned into two parts by the vertical partition 20 to form two storage compartments S3 and S4 in the horizontal direction, as in the freezing compartment FC, the front surface and the rear surface of each of the storage compartments S3 and S4 may be defined by the inner surface of the cabinet 10. The upper surface of each of the storage compartments S3 and S4 may be defined by the bottom surface of the horizontal partition 7, which partitions the refrigerating compartment RC and the freezing compartment FC from each other. One of the side surfaces of each of the storage compartments S3 and S4 may be defined by the inner surface of the cabinet 10. The other side surface of each of the storage compartments S3 and S4 may be defined by one surface of the vertical partition 20 that faces the one side surface.

Of course, In other embodiments, in the case in which the refrigerating compartment RC is partitioned into a pair of storage compartments by the vertical partition, one side surface and the rear surface of each of the storage compartments may be defined by the inner surface of the cabinet 10, the bottom surface of each of the storage compartments may be defined by the upper surface of the horizontal partition 7, and the other side surface of each of the storage compartments may be defined by one surface of the vertical partition that faces the one side surface.

The doors 3*a*, 3*b*, 3*c*, and 3*d* are hinged to the cabinet 10 to open and close the open front surfaces of the storage compartments S1, S2, S3, and S4. The doors 3*a*, 3*b*, 3*c*, and 3*d* may be provided so as to correspond to the storage compartments S1, S2, S3, and S4. A door storage unit for storing food may be formed in the rear parts of the doors 3*a*, 3*b*, 3*c*, and 3*d*, i.e. the parts of the doors 3*a*, 3*b*, 3*c*, and 3*d* that face the open front surfaces of the storage compartments S1, S2, S3, and S4. The door storage unit may include storage chambers 8*a* for storing food that is frequently taken out of the refrigerator, such as dairy products, beverages, vegetables, etc, a tray 8*b* for storing ice, and baskets 8*c* for storing small-sized frozen food. In the state in which the doors 3*a*, 3*b*, 3*c*, and 3*d* are closed, at least a portion of the door storage unit may be located in the storage compartments S1, S2, S3, and S4.

Drawers D may be disposed in the compartments RC and FC or the storage compartments S1, S2, S3, and S4. The drawers D are provided to store or hold food. The drawers D may be supported by drawer guides DG, such as cantilevers, rails, and rollers, so as to be movable in the forward-rearward direction. A plurality of drawers D may be disposed in each of the storage compartments S1, S2, S3, and S4 so as to be arranged in the upward-downward direction. In this case, a plurality of drawer guides DG may be provided so as to correspond to the drawers D.

Each drawer D may be constituted by a container (or a bin) 320 having a space for storing food. The container 320 may include side walls defining the left and right sides of the space and a rear wall interconnecting the rear ends of the side walls.

Alternatively, each drawer D may be constituted by a horizontal plate-shaped shelf 310. The shelves 310 may be movably supported by the cantilevers 40*a* fixed to the rear surfaces of the storage compartments S1, S2, S3, and S4. However, the present invention is not limited thereto.

Of course, each drawer D may be moved along a corresponding drawer guide DG when a user pushes or pulls the drawer D while holding the drawer D. However, the present invention is not limited thereto. The drawers D may automatically move in response to the opening and closing operation of the doors 3*a*, 3*b*, 3*c*, and 3*d*. To this end, a frame 50, connected to the doors 3*a*, 3*b*, 3*c*, and 3*d* via a link 70, is provided. The frame 50 is interlocked with the doors 3*a*, 3*b*, 3*c*, and 3*d* to move the drawers D in response to the opening and closing operation of the doors 3*a*, 3*b*, 3*c*, and 3*d*.

Figure 3:
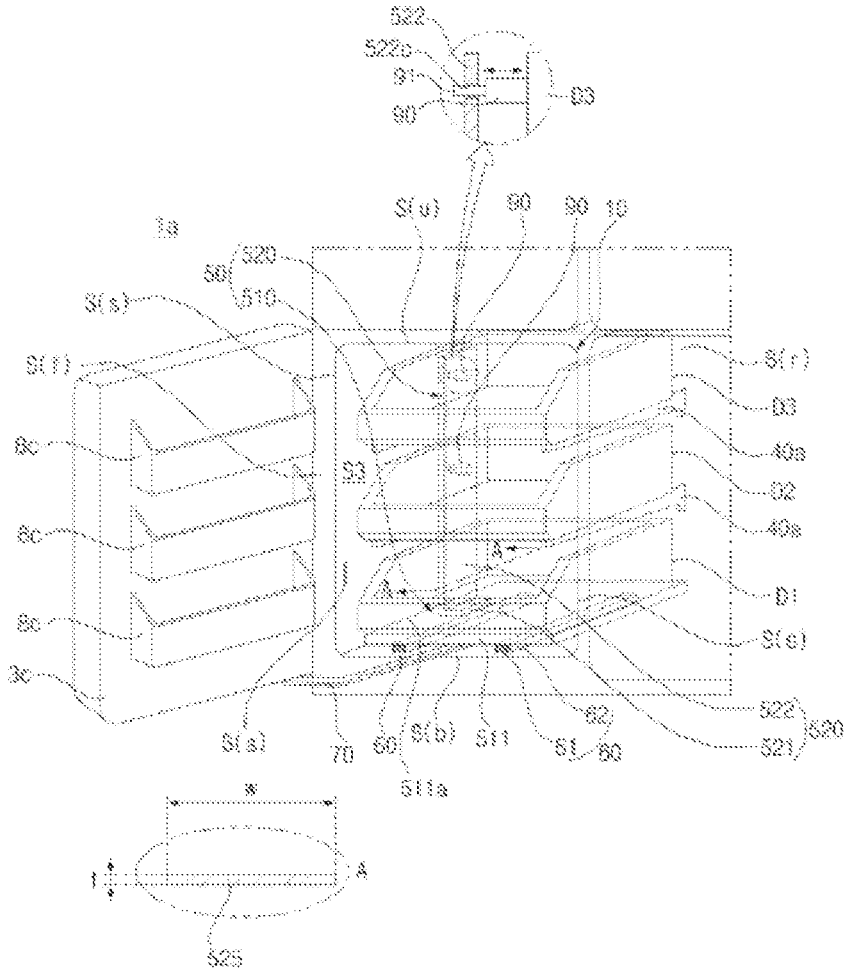
FIG. 3 is a perspective view schematically showing a refrigerator according to a first embodiment of the present invention.
Figure 4B:
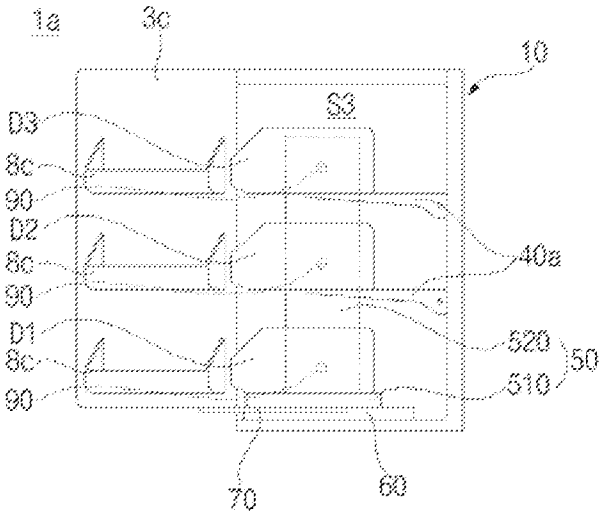
Figure 4A:
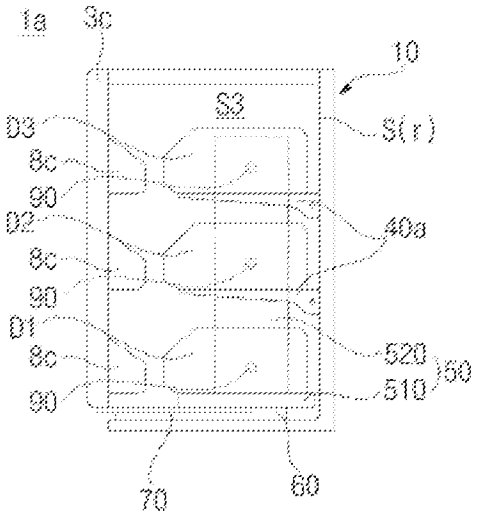

FIG. 3 is a perspective view schematically showing a refrigerator 1*a* according to a first embodiment of the present invention. FIGS. 4A and 4B are a side view showing the refrigerator 1*a* of FIG. 3, wherein FIG. 4A shows the state in which a door is closed and FIG. 4B shows the state in which the door is open. Hereinafter, a left freezing storage compartment S3 will be described by way of example. Of course, the structure of the left freezing storage compartment S3, which will described in other embodiments as well as this embodiment, may be applied to the other storage compartments.

The refrigerator 1*a* may include a cabinet 10, a door 3*c*, drawer guides DG (hereinafter, referred to as cantilevers 40*a*), drawers D (hereinafter, denoted by D1, D2, and D3 when it is necessary to distinguish the drawers D from each other), a frame 50, a frame guide 60, a link 70, and interlocking units 90.

The cantilevers 40*a* support the drawers D so as to be movable in the forward-rearward direction. The cantilevers 40*a* are disposed in the storage compartment S3. The rear end of each of the cantilevers 40*a* may be coupled to the rear surface S(r) of the storage compartment S3. The cantilevers 40*a* may extend horizontally toward the front surface S(f) of the storage compartment S3, which is open. The cantilevers 40*a* may be at the lower sides of the drawers D to support the bottom surfaces of the drawers D.

A plurality of drawers D may be provided so as to be arranged in the upward-downward direction. Correspondingly, a plurality of cantilevers 40*a* may also be provided. In this embodiment, the lowermost one of the drawers D1, D2, and D3, i.e. the drawer D1, is supported by a base part 510, and the other two drawers D2 and D3 are supported by the cantilevers 40*a*.

Slots 115 (see FIG. 11), into which the rear ends of the cantilevers 40*a* are separably (or selectively) coupled, may be formed in the rear surface S(r) of the storage compartment S. A plurality of slots 115 may be provided so as to be arranged in the upward-downward direction. A user may selectively mount the cantilevers 40*a* into desired ones of the slots 115.

The cantilevers 40*a* may support the bottom surfaces of the drawers D. Grooves (not shown), extending in the longitudinal direction of the cantilevers 40*a* so as to be guided along the upper ends of the cantilevers 40*a* during the movement of the drawers D, may be formed in the bottom surfaces of the drawers D.

In the case in which each drawer D is supported by a pair of cantilevers 40*a*, a pair of slots 115 may be arranged in the horizontal direction such that the cantilevers 40*a* are coupled into the slots 115, and a plurality of slots 115 may be arranged at different heights in the vertical direction.

The drawers D are supported by the cantilevers 40*a* in a state of static mechanical equilibrium. That is, the entire load of each drawer D is supported by the cantilevers 40*a*. Each drawer D remains stationary on the cantilevers 40*a* unless external force is applied to the drawer D. In this embodiment, in order to support each drawer D in a state of static mechanical equilibrium, a pair of cantilevers 40*a* is disposed so as to be symmetrical with respect to the drawer D. However, the present invention is not limited thereto. For example, each drawer D may be supported by a single cantilever 40*a* in a state of static mechanical equilibrium as long as there is sufficient contact area between the drawer D and the cantilever 40*a*.

The frame 50 is connected to the door 3*c* via the link 70 so as to move in the forward-rearward direction in response to the opening and closing operation of the door 3*c*. The frame 50 may include a base part 510 connected to the link 70 at the lower side of the lowermost drawer D and a side plate 520 extending upward from the base part 510 up to at least a height corresponding to the uppermost drawer D.

Figure 14:
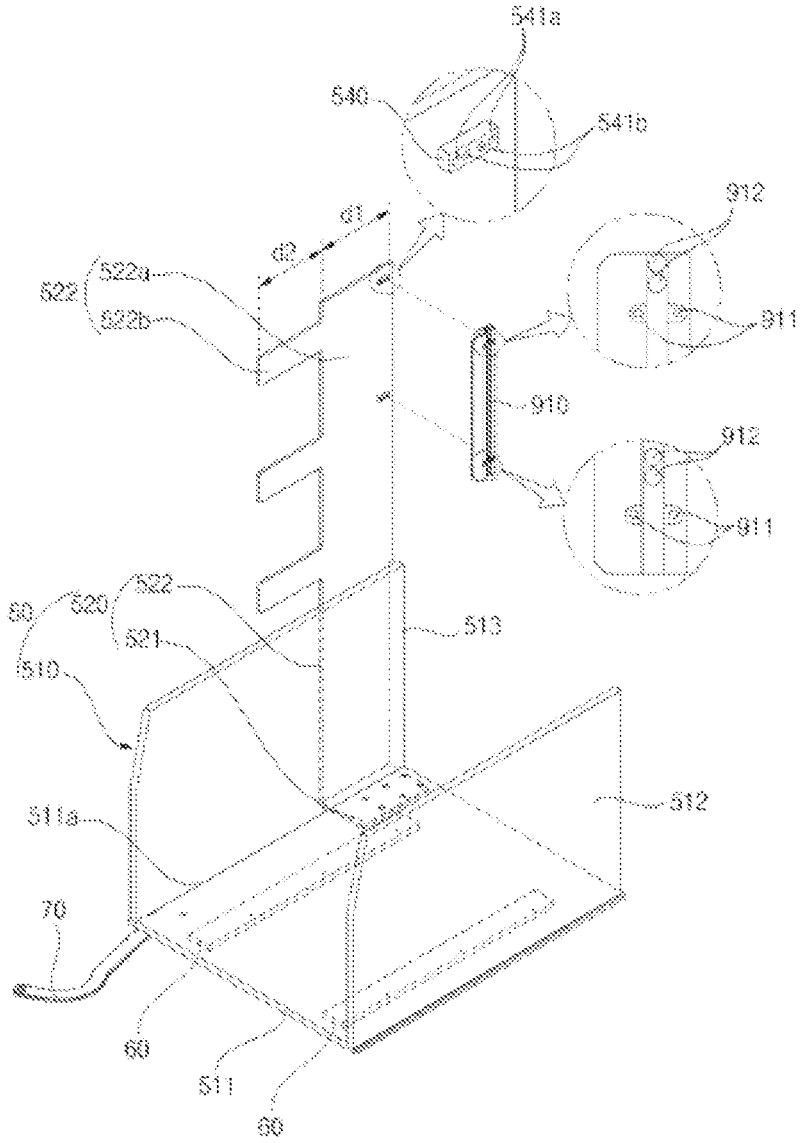
FIG. 14 is a view showing the assembly shown in FIG. 13, from which the drawers are removed.

The base part 510 may include a horizontal plate 511 disposed at the lower side of the drawer D3. The base part 510 shown in FIG. 3 is constituted by the horizontal plate 511 alone. However, the present invention is not limited thereto. As shown in FIG. 14, the base part 510 may include one or more support walls 512 and 513 extending upward from the horizontal plate 511.

The upper surface of the horizontal plate 511 faces the upper surface S(u) of the storage compartment S3, and the bottom surface of the horizontal plate 511 faces the bottom surface S(b) of the storage compartment S3.

That the side plate 520 extends to reach a height corresponding to the uppermost drawer D means that the side plate 520 extends up to a height that is higher than the lowermost end of the uppermost drawer D, which is to be withdrawn by the frame 50. For example, in order to automatically withdraw two drawers D2 and D3 disposed above the base part 510 while being spaced apart from the base part 510 using the frame 50, as in this embodiment, the side plate 520 may extend up to a height that is higher than the lowermost end of the upper one of the drawers D2 and D3, i.e. the drawer D3.

The side plate 520 may include a horizontal part 521 coupled to the horizontal plate 511 and a vertical part 522 bent from the horizontal part 521 and extending upward. The vertical part 522 may be disposed between the drawers D and the side surface S(s) of the storage compartment S3. The vertical part 522 may have a horizontal section 525 that extends in the forward-rearward direction.

That is, the vertical part 522 is a plate having a thickness extending in the leftward-rightward direction and an area extending in the upward-downward and forward-rearward directions. When the vertical part 522 is cut along an arbitrary horizontal plane, as indicated by part A of FIG. 3, the section 525 has a forward-rearward length w that is much longer than the thickness t. Thanks to the plate structure, the vertical part 522 may effectively resist external force, such as tension, twisting, and bending, which may occur due to inertia or repulsion of the drawers D during the movement of the drawers D. In addition, since the space in the storage compartment S3 occupied by the vertical part 522 is small, it is possible to minimize the reduction in internal volume (or storage capacity) of the storage compartment S3.

The vertical part 522 may be configured such that the forward-rearward length w of the horizontal section 525 is shorter than the forward-rearward length of the horizontal plate 511. In this structure, the disturbance of circulation of cool air by the vertical part 522 may be reduced, particularly in the case in which a discharge port for discharging cool air is provided above the side surface S(s) of the storage compartment S3.

The interlocking units 90 may connect the drawers D to the side plate 520 such that the drawers D are interlocked with the side plate 520. The interlocking units 90 may include connection protrusions 91 protruding from the drawers D toward the side surface S(s) of the storage compartment S3 so as to be coupled to the side plate 520. The vertical part 522 may be provided with protrusion fastening holes 522*c*, into which the connection protrusions 91 are inserted. The connection protrusions 91 may be separably coupled into the protrusion fastening holes 522*c*.

The connection protrusions 91 may be disposed on the drawers D so as to be moved in the lateral direction. The connection protrusions 91 may be inserted into or separated from the protrusion fastening holes 522*c* depending on the position of the connection protrusions 91 after the movement thereof. That is, when the connection protrusions 91 move toward the side surface S(s) of the storage compartment S3 adjacent to the side plate 520, the connection protrusions 91 may be coupled into the protrusion fastening holes 522*c*. When the connection protrusions 91 move away from the side surface S(s) of the storage compartment S3 adjacent to the side plate 520, the connection protrusions 91 may be separated from the protrusion fastening holes 522*c*.

In the case in which the drawers D2 and D3, which are supported by the cantilevers 40*a*, are arranged in the upward-downward direction, a plurality of protrusion fastening holes may be formed in the side plate 520 so as to be arranged in the upward-downward direction. The protrusion fastening holes may be formed at heights corresponding to the drawers D2 and D3.

Each of the protrusion fastening holes corresponds to any one of the drawers D2 and D3. The interlocking units 90 are connect the drawers D1, D2, and D3 to protrusion fastening holes corresponding thereto. That is, a plurality of interlocking units 90 may be provided. A user may selectively connect the drawers D1, D2, and D3 to the side plate 520 using the interlocking units 90. Consequently, the drawers D1, D2, and D3 may be moved together by the side plate 520.

In other embodiments, the interlocking units 90 may be provided on the side plate 520 so as to be moved in the lateral direction. In this case, the connection protrusions 91 may be coupled into or separated from protrusion fastening holes (not shown) formed in the side surfaces of the drawers D depending on the position of the connection protrusions 91 on the side plate 520.

The drawer D1, which is supported by the base part 510, may be interlocked with the frame 50 without being connected to the vertical part 522 via an interlocking unit 90. Consequently, an interlocking unit 90 corresponding to the drawer D1 may not be provided.

In the structure in which the drawers D are supported by the cantilevers 40*a* in a state of static mechanical equilibrium, the frame 50 moves the drawers D2 and D3, which are supported by the cantilevers 40*a*, but does not support the load of each of the drawers D2 and D3, even though the drawers D are connected to the vertical part 522 via the interlocking units 90. Consequently, the load applied to the frame 50 is small, with the result that the frame 50 is not easily deformed. Particularly in the case in which the drawer D1, which is supported by the base part 510, is provided, it is possible to secure the rigidity of the vertical part 522 if the vertical part 522 is formed so as to have the shape of a thin plate, since the load of the drawer D1 is not applied to the vertical part 522.

In addition, since the load of each of the drawers D2 and D3, which are supported by the cantilevers 40*a*, is not applied to the frame guide 60, the frame guide 60 is not easily deformed even after long-term use thereof. Furthermore, a bearing member, such as a rail or a roller, constituting the frame guide 60, is not easily worn, or is prevented from being constrained and thus abnormally operated due to the concentration of load.

The frame guide 60 may be disposed between the bottom surface S(b) of the storage compartment S3 and the base part 510 to support the base part 510 such that the base part 510 is movable in the forward-rearward direction. The frame guide 60 may be fixed in the storage compartment S3 to guide the base part 510 such that the base part 510 is movable in the forward-rearward direction. A pair of frame guides 60 may be at positions spaced apart from each other in the lateral direction (or the leftward-rightward direction) in the storage compartment.

The frame guide 60 may be formed to have various shapes, including that of a rail or a roller. For example, the frame guide 60 may include a stationary rail 61 fixed to the bottom surface S(b) of the storage compartment S3 and extending in the forward-rearward direction and a moving rail 62 fixed to the bottom surface of the horizontal plate 511 so as to slide along the stationary rail 61.

The frame 50 may be connected to the door d3 via the link 70. Consequently, the frame 50 may be moved in response to the turning of the door 3*c*. When the door 3*c* is opened, the link 70 pulls the frame 50 in the forward direction, with the result that the frame 50 is moved in the forward direction. On the other hand, when the door 3*c* is closed, the link 70 pushes the frame 50 in the rearward direction, with the result that the frame 50 is moved in the rearward direction.

The front end of the link 70 is turnably connected to the door 3*c*, and the rear end of the link is turnably connected to the base part 510. Consequently, the link 70 may move the base part 510 according to the turning of the door 3*c*.

The link 70 may interconnect the door 3*c* and the base part 510. The front end of the link 70 may be turnably connected to the door 3*c*, and the rear end of the link may be turnably connected to the base part 510. The rear end of the link may be connected to the bottom surface of the horizontal plate 521. At least a portion of the link 70 may be disposed between the horizontal plate 511 and the bottom surface S(b) of the storage compartment S.

In the state in which the door 3*c* is fully open, i.e. in the state in which the frame 50 is maximally withdrawn in the forward direction by the link 70, the drawers D do not pass over the front surface S(f) of the storage compartment S3. However, the movable range of the drawers D that is allowed by the cantilevers 40*a* is not limited such that the drawers D do not pass over the front surface S(f) of the storage compartment S3. That is, the drawers D are moved by the frame 50 in the forward direction up to a position where the drawers D do not pass over the front surface S(f) of the storage compartment S3. However, this means that the drawers D are automatically withdrawn to the final positions thereof by the frame 50. In other embodiments, a user may further withdraw the drawers D manually even in the state in which the door 3*c* is fully open. To this end, the cantilevers 40*a* may be configured to guide the movement of the drawers D such that the drawers D pass over the distance to which the drawers D are automatically withdrawn by the frame 50.

Meanwhile, the frame 50, the link 70, the frame guide 60, and the cantilevers 40*a* are equally applied to embodiments that will be described later with reference to FIGS. 5A and 5B to 10. Consequently, it should be noted that components of the embodiments that are not described have the same construction as described above.

Figure 5B:
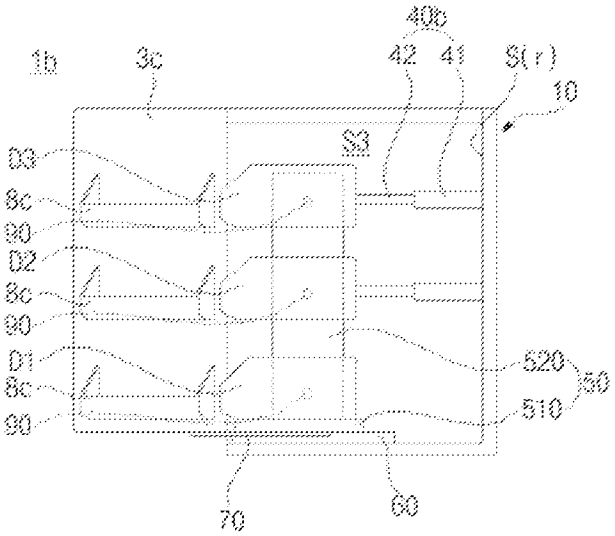
Figure 5A:
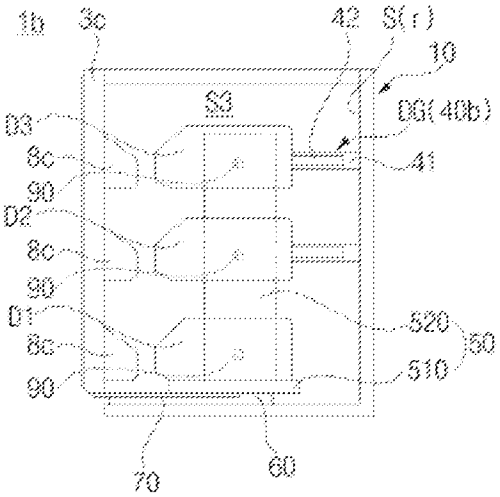

FIGS. 5A and 5B are a side view showing a refrigerator 1*b* according to a second embodiment of the present invention, wherein FIG. 5A shows the state in which a door 3*c* is closed and FIG. 5B shows the state in which the door 3*c* is open. Hereinafter, the refrigerator according to the second embodiment will be described with reference to FIGS. 5A and 5B.

The refrigerator 1*b* may include horizontal support bars 40*b* for supporting the drawers D. The length of the horizontal support bars 40*b* may be variable. The horizontal support bars 40*b* are disposed in the storage compartment S3 to interconnect the rear surface S(r) of the storage compartment S3 and the drawers D. The horizontal support bars 40*b* support the drawers D such that the drawers are located at predetermined heights in the storage compartment S3.

The length of the horizontal support bars 40*b* may vary corresponding to the distance between the rear surface S(r) of the storage compartment S3 and the drawers D. When the door 3 is opened, the drawers D are moved in the forward direction by the frame, with the result that the distance between the rear surface S(r) of the storage compartment S3 and the drawers D is increased. At this time, the length of the horizontal support bars 40*b* is increased. On the other hand, when the door 3 is opened, the drawers D are moved in the rearward direction by the frame. At this time, the length of the horizontal support bars 40*b* is decreased.

Each of the horizontal support bars 40*b* may include a stationary horizontal bar 41 extending in the forward-rearward direction and fixed to the rear surface S(r) of the storage compartment S3 and a moving horizontal bar 42 coupled to the stationary horizontal bar 41 so as to extend in the longitudinal direction of the horizontal support bar 40*b*. When the door 3*c* is opened, the moving horizontal bar 42 is moved in the forward direction together with a corresponding one of the drawers D, with the result that the total length of each of the horizontal support bars 40*b* is increased.

Each of the horizontal support bars 40*b*, the length of which is variable, may have various structures. In this embodiment, each of the horizontal support bars 40*b* is configured to have a structure in which the moving horizontal bar 42, which is inserted into the cylindrical stationary horizontal bar 41, is moved together with a corresponding one of the drawers D, whereby the total length of each of the horizontal support bars 40*b* is variable. However, the present invention is not limited thereto.

One end (or the front end) of the moving horizontal bar 42 may be coupled to the rear surface of a corresponding one of the drawers D that faces the rear surface of the storage compartment S. The moving horizontal bar 42 may extend substantially in the horizontal direction. Correspondingly, the stationary horizontal bar 41 may also extend in the horizontal direction. The end (or the rear end) of the stationary horizontal bar 41 may be fixed to the rear surface S(r) of the storage compartment S at substantially the same height as the moving horizontal bar 42. In this structure, the horizontal support bars 40*b* are hidden by the drawers D when the interior of the storage compartment S is viewed from the front, whereby the horizontal support bars 40*b* or the structures in which the horizontal support bars 40*b* are mounted are hidden.

In the case in which a plurality of drawers D2 and D3 is provided so as to be spaced apart from the base part 510, the horizontal support bars 40*b* may be provided so as to correspond to the drawers D2 and D3. The drawers D2 and D3 may be supported by the horizontal support bars 40*b* in a state of static mechanical equilibrium. A pair of horizontal support bars 40*b* may be provided at one drawer so as to be symmetrical with respect to the drawer.

In this embodiment, three drawers D1, D2, and D3 are disposed in the upward-downward direction, and each of the drawers D2 and D3 is supported by a pair of horizontal support bars 40*b* spaced apart from each other in the width direction of the storage compartment S3. However, the lowermost one of the drawers D1, D2, and D3, i.e. the drawer D1, is supported by the base part 510 of the frame 50.

Figure 6:
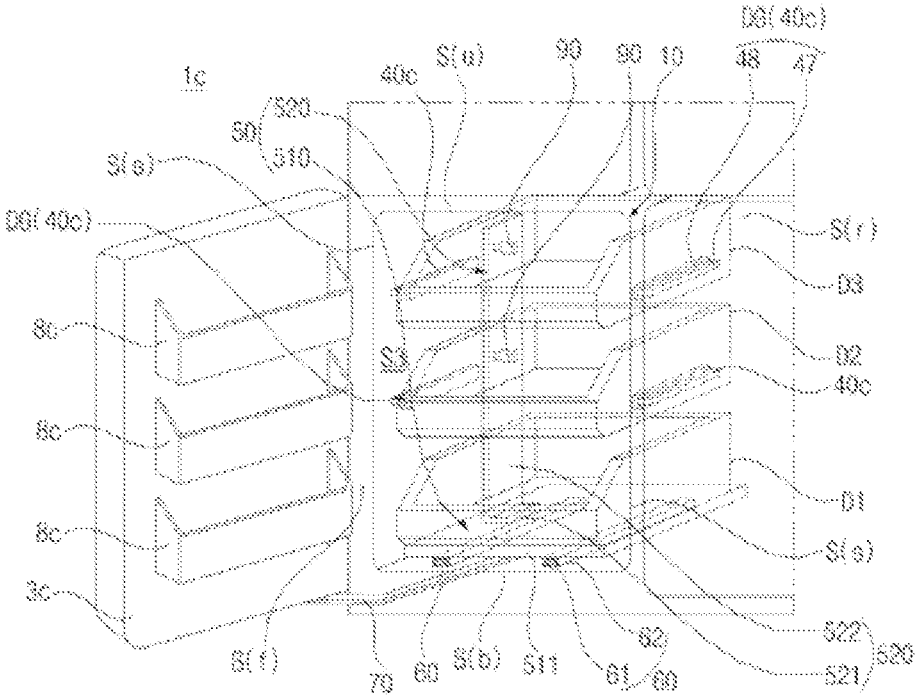
FIG. 6 is a perspective view schematically showing a refrigerator according to a third embodiment of the present invention.
Figure 7B:
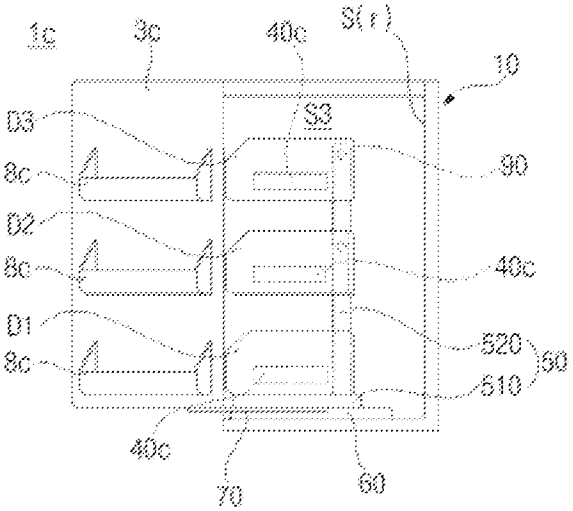
Figure 7A:
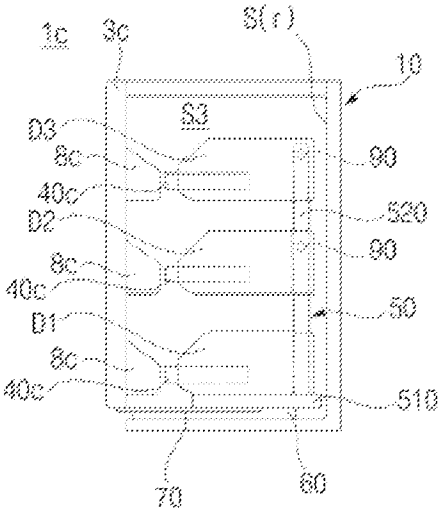

FIG. 6 is a perspective view schematically showing a refrigerator 1*c* according to a third embodiment of the present invention. FIGS. 7A and 7B are a side view showing the refrigerator 1*c* of FIG. 6, wherein FIG. 7A shows the state in which a door is closed and FIG. 7B shows the state in which the door is open. Hereinafter, the refrigerator according to the third embodiment will be described with reference to FIGS. 6 and 7.

Drawer guides DG are provided to guide the movement of the drawers D in the forward-rearward direction. The drawers D may be supported by the drawer guides DG in a state of static mechanical equilibrium. A pair of drawer guides DG may be disposed in the storage compartment S3 so as to be spaced apart from each other in the width direction (or the leftward-rightward direction). Each of the drawer guides DG may be disposed between a corresponding one of the drawers D and the side surface S(s) of the storage compartment S3.

Each of the drawer guides DG may be formed to have various shapes, including that of a rail or a roller. In this embodiment, each of the drawer guides 40*c* may include a stationary rail 47 fixed to the side surface S(s) of the storage compartment S3 and extending in the forward-rearward direction and a moving rail 48 fixed to a corresponding one of the drawers D so as to slide along the stationary rail 47 during the movement of the drawer D. The moving rail 48 may be fixed to the side surface of the drawer D that faces the side surface S(s) of the storage compartment S3.

In another example, each of the drawer guides DG may include a stationary rail fixed to the side surface S(s) of the storage compartment S3 and a moving rail rotatably provided at a corresponding one of the drawers D so as to roll along the stationary rail during the movement of the drawer D.

The vertical part 522 of the side plate 520 is disposed between the drawer guides 40*c* and the rear surface S(r) of the storage compartment S3 so as to avoid interference with drawer guides 40*c*. In addition, the movable range of the vertical part 522 according to the turning of the door 3*c* may be limited to the area between the drawer guides 40*c* and the rear surface S(r) of the storage compartment S3. In particular, each interlocking unit 90 may be disposed at the rear of the moving rail 48, which is disposed at a corresponding one of the drawers D. The vertical part 522 may be disposed at the rear of the stationary rail 47, and each of the interlocking units 90 may be disposed at the rear of the moving rail 48, which is fixed to a corresponding one of the drawers D.

Even in the case in which the vertical part 522 is in tight contact with the side surface S(s) of the storage compartment S3 or is sufficiently close to the side surface S(s) of the storage compartment S3, the vertical part 522 may be located at the rear of the stationary rail 47 even in the state in which each of the drawers D is maximally withdrawn by the frame 50 in the forward direction such that the front end of the vertical part 522 does not interfere with the stationary rail 47 when the vertical part 522 is moved in the forward direction by the link 70.

Figure 8:
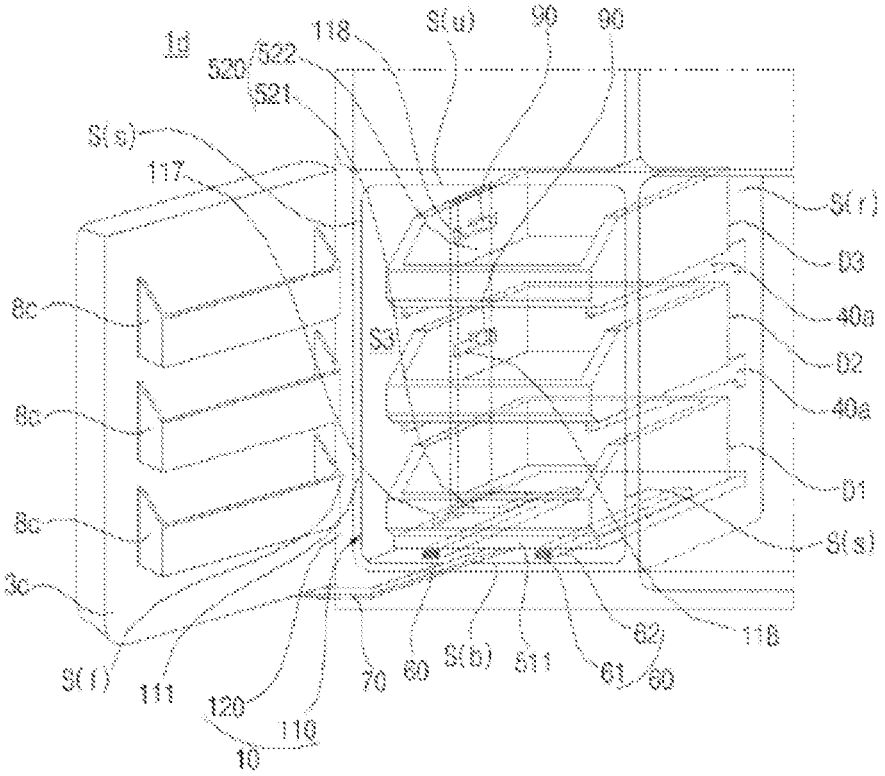
FIG. 8 is a perspective view schematically showing a refrigerator 1*d* according to a fourth embodiment of the present invention.

FIG. 8 is a perspective view schematically showing a refrigerator 1*d* according to a fourth embodiment of the present invention. Referring to FIG. 8, a cabinet 10 may include an inner cabinet 110 and an outer cabinet 120. A storage compartment (e.g. a left freezing storage compartment S) is defined in the inner cabinet 110.

The outer cabinet 120 is disposed outside the inner cabinet 110 to form a predetermined space between the outer cabinet 120 and the inner cabinet 110. In particular, the side surface S(s) of the storage compartment S3 is defined by a side wall 111 of the inner cabinet 110. A vertical part 522 of a side plate 520 may be disposed in a space between the side wall 111 of the inner cabinet 110 and the outer cabinet 120.

In order to provide a structure in which a base part 510 is disposed in the inner cabinet 110 and the vertical part 522 is disposed outside the inner cabinet 110, a frame guide slit 117, through which the base part 510 or the side plate 520 passes, may be formed in the inner cabinet 110. That is, the base part 510 and the side plate 520 are connected to each other through the frame guide slit. In this embodiment, a horizontal part 521 of the side plate 520 is disposed so as to extend through the frame guide slit 117 such that one end of the horizontal part 521 is coupled to the base part 510. The vertical part 522, which extends from the other end of the horizontal part 521, is disposed between the side wall 111 of the inner cabinet 110 and the outer cabinet 120.

The frame guide slit 117 may be longer than the forward-rearward length of the horizontal part 521 such that the horizontal part 521, which extends through the frame guide slit 117, can move in the forward-rearward direction.

Since the vertical part 522 of the side plate 520 is disposed between the inner cabinet 110 and the outer cabinet 120, the circulation of cool air in the storage compartment S3 is not impeded by the vertical part 522, and the vertical part 522 is not exposed to a user.

In addition, since the vertical part 522 is located outside the storage compartment S3, interference between food placed on drawers (particularly, shelves 310) and the vertical part 522 is prevented.

Meanwhile, since the vertical part 522 is located outside the inner cabinet 110, interlocking unit guide slits 118, through which interlocking units 90 pass, may be formed in the side wall 111 of the inner cabinet 110 such that the interlocking units 90 connect the vertical part 522 and the drawers D. The interlocking unit guide slits 118 extend in the forward-rearward direction. During the movement of the drawers D, the interlocking units 90 may be guided along the interlocking unit guide slits 118. In a structure in which a plurality of drawers D2 and D3 supported by cantilevers 40*a* is provided, as in this embodiment, a plurality of interlocking unit guide slits 118 may be formed in the upward-downward direction.

The interlocking units 90 may be provided on the drawers D2 and D3 so as to be moved in the lateral direction. Connection protrusions 91 (see FIG. 3) of the interlocking units 90 may be inserted into protrusion fastening holes 522*c* (see FIG. 3), which are formed in the vertical part 522, or may be separated from the protrusion fastening holes 522*c* through the interlocking unit guide slits 118.

Figure 9B:
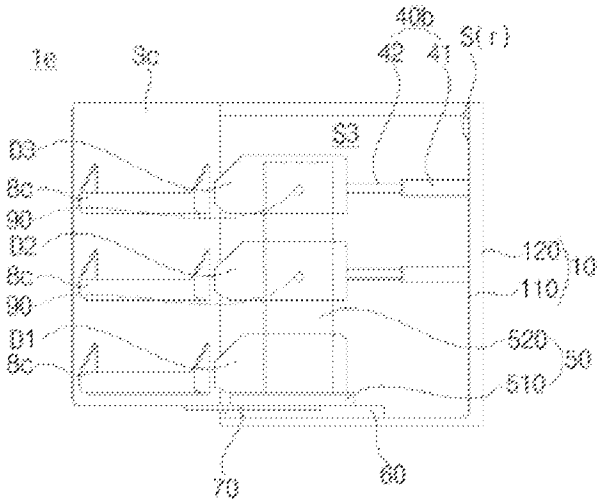
Figure 9A:
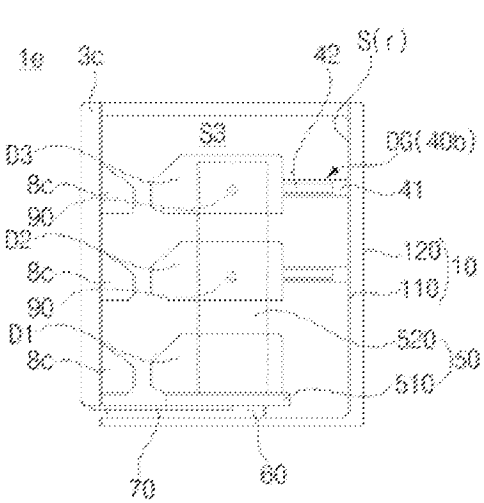

FIGS. 9A and 9B are a side view showing a refrigerator 1*e* according to a fifth embodiment of the present invention, wherein FIG. 9A shows the state in which a door is closed and FIG. 9B shows the state in which the door is open. Referring to FIGS. 9A and 9B, the refrigerator 1*e* according to this embodiment is different from the refrigerator 1*d* described with reference to FIG. 8 in that drawers D are supported by extendable horizontal support bars 40*b*. The horizontal support bars 40*b* are substantially the same as those shown in FIGS. 5A and 5B, and therefore a description thereof will be omitted.

Figure 10:
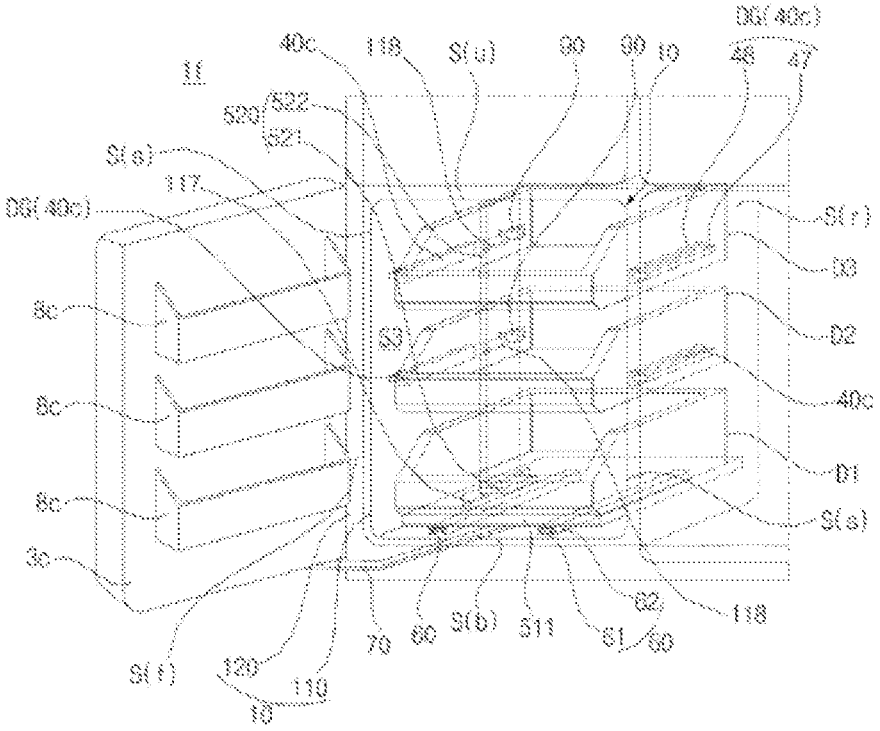
FIG. 10 is a perspective view schematically showing a refrigerator according to a sixth embodiment of the present invention.

FIG. 10 is a perspective view schematically showing a refrigerator if according to a sixth embodiment of the present invention. Hereinafter, a left freezing storage compartment S3 will be described by way of example. The structure of the left freezing storage compartment S3, which will be described hereinafter, may be applied to the other storage compartments.

Referring to FIG. 10, the refrigerator if is different from the refrigerator 1*c* shown in FIGS. 6 and 7 in that a vertical part 522 of a side plate 520 is disposed between a side wall 111 of an inner cabinet 110 and an outer cabinet 120. A door 3, drawer guides 40*c*, drawers D, a frame guide 60, a link 70, and interlocking units 90 are substantially the same as those described above, and therefore a description thereof will be omitted.

In the same manner as in the previous embodiments, described with reference to FIGS. 8 and 9, a frame guide slit 117 and interlocking unit guide slits 118 may be formed in the side wall 111 of the inner cabinet 110.

The interlocking units 90 and the interlocking unit guide slits 118 are positioned such that the interlocking units 90 do not interfere with the drawer guides 40*c* during the movement of the interlocking units 90. In this embodiment, the interlocking unit guide slits 118 are formed to be higher than the drawer guides 40*c*. However, the present invention is not limited thereto. For example, the interlocking unit guide slits 118 are formed to be lower than the drawer guides 40*c*. Alternatively, similarly to those described with reference to FIGS. 7A and 7B, the interlocking unit guide slits 118 are formed to be located at the rear of the drawer guides 40*c* such that the interlocking units 90 are moved between the drawer guides 40*c* and the rear surface S(r) of the storage compartment S3.

Figure 11:
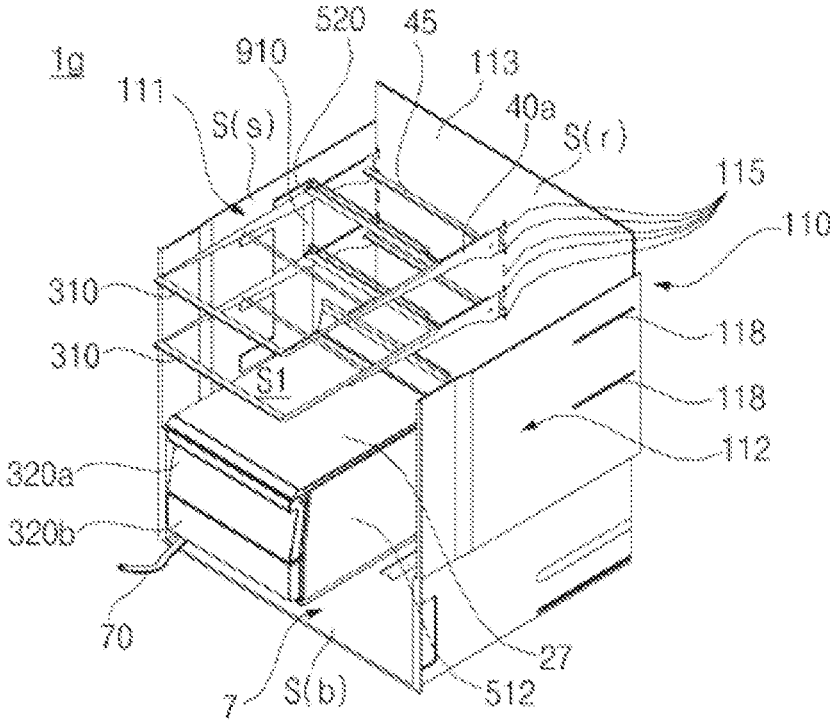
FIG. 11 is a cutaway view showing a refrigerating compartment of a refrigerator according to a seventh embodiment of the present invention.
Figure 12:
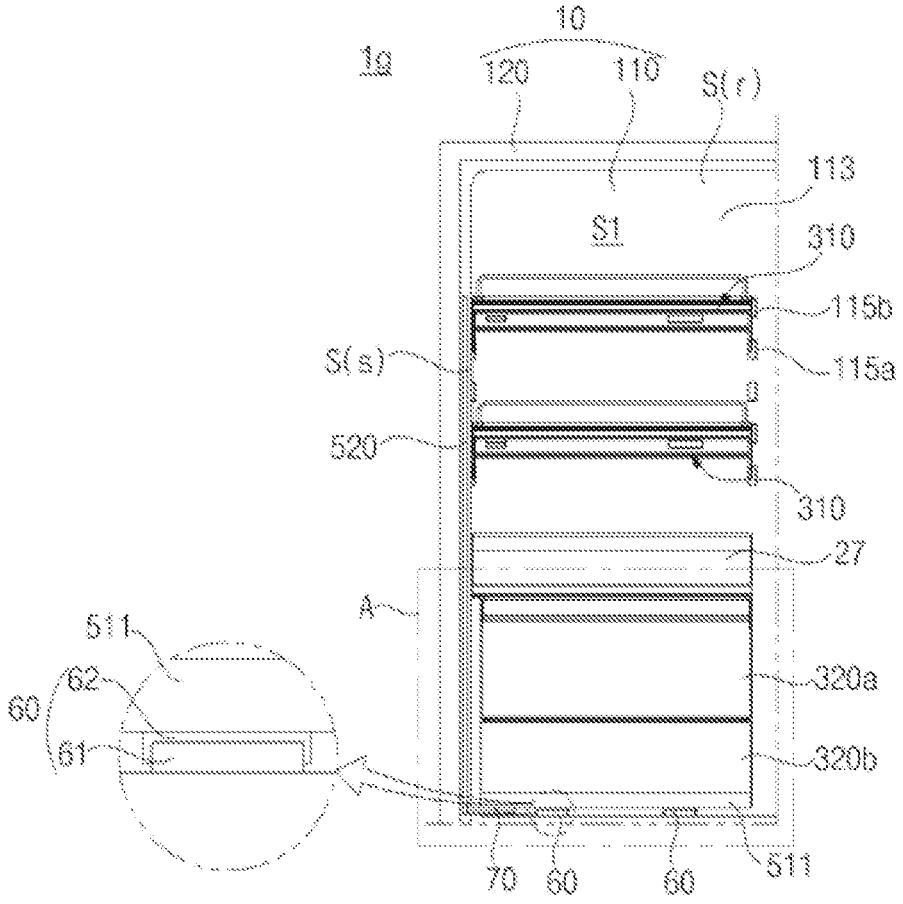
FIG. 12 is a front view showing a left refrigerating storage compartment of the refrigerating compartment of FIG. 11.
Figure 13:
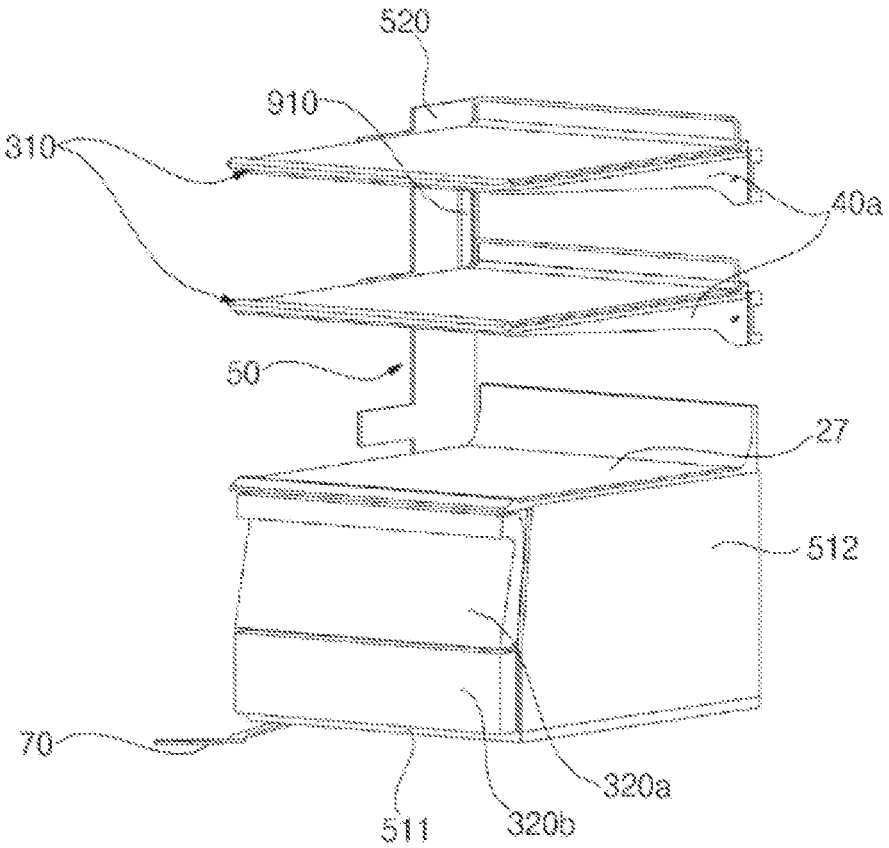
FIG. 13 is a view showing an assembly of a frame and drawers shown in FIGS. 11 and 12.
Figure 15:
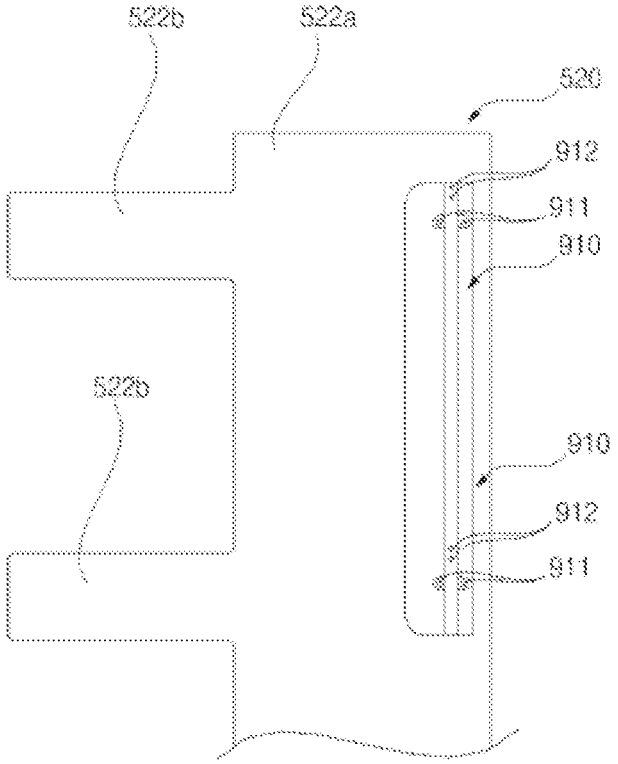
FIG. 15 is a view showing the state in which a middle interlocking member is connected to a side plate.
Figure 16:
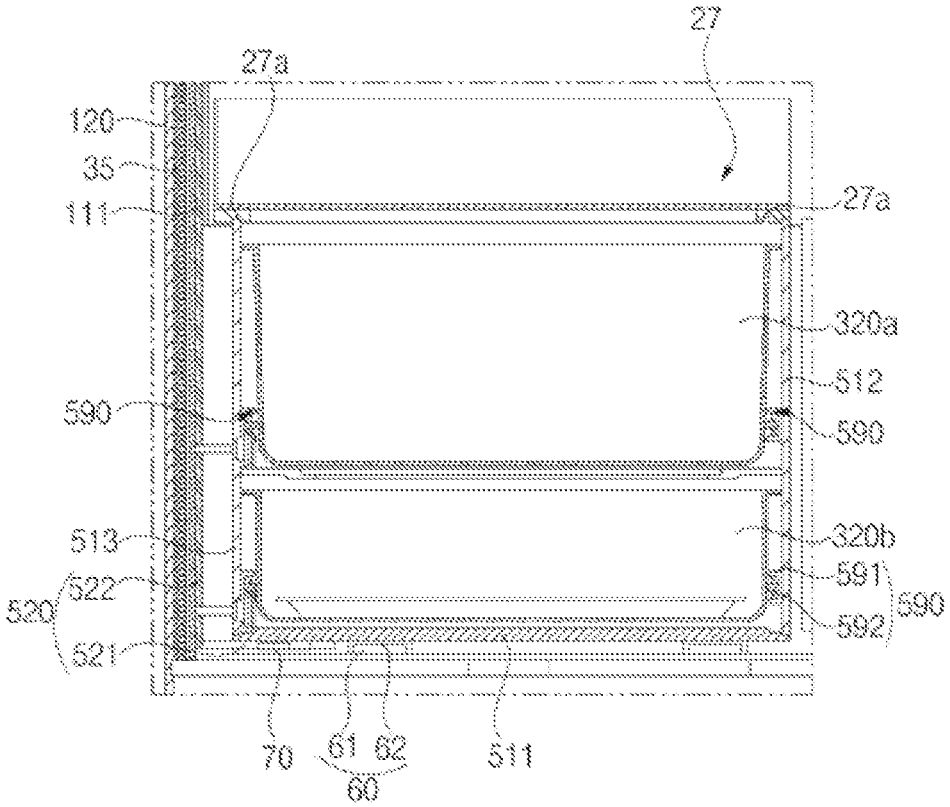
FIG. 16 is an enlarged sectional view showing part A of FIG. 12.
Figure 17:
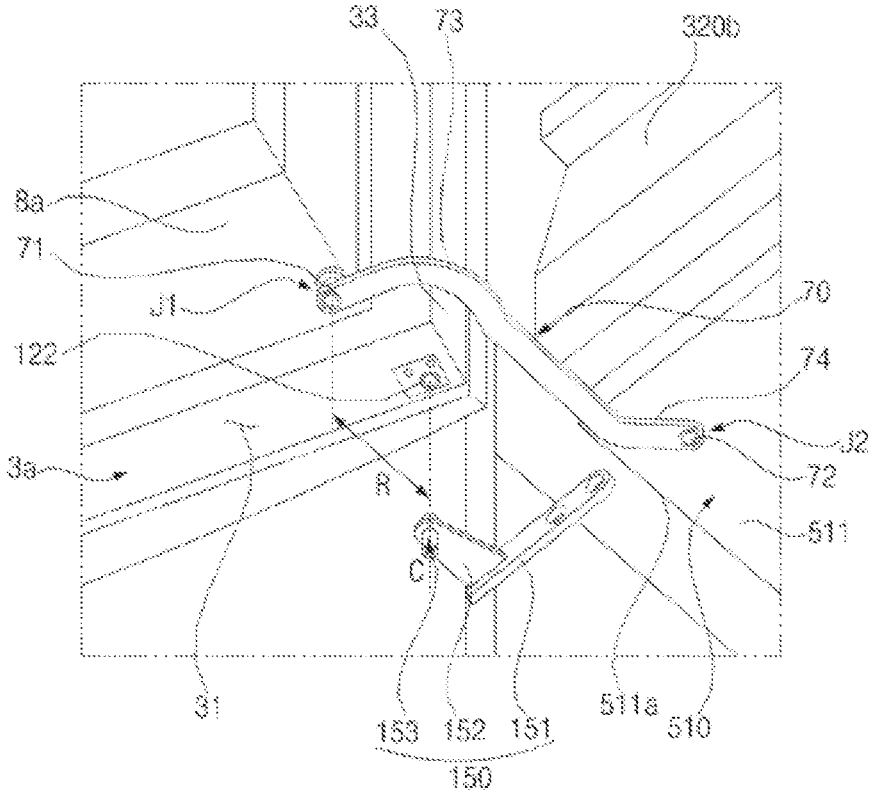
FIG. 17 is a view showing a structure in which a door and a base part are connected to each other via a link.
Figure 18A:
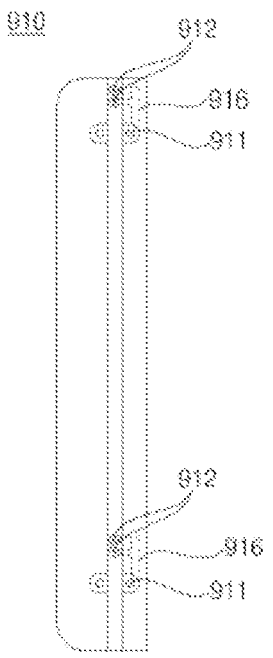
Figure 18B:
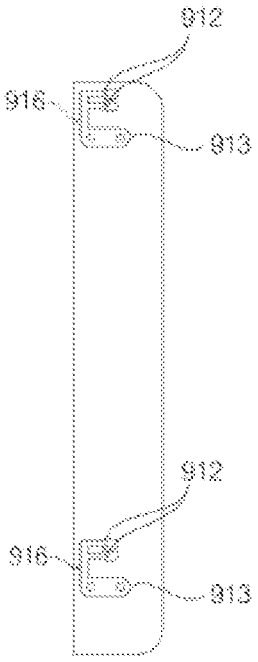
Figure 19:
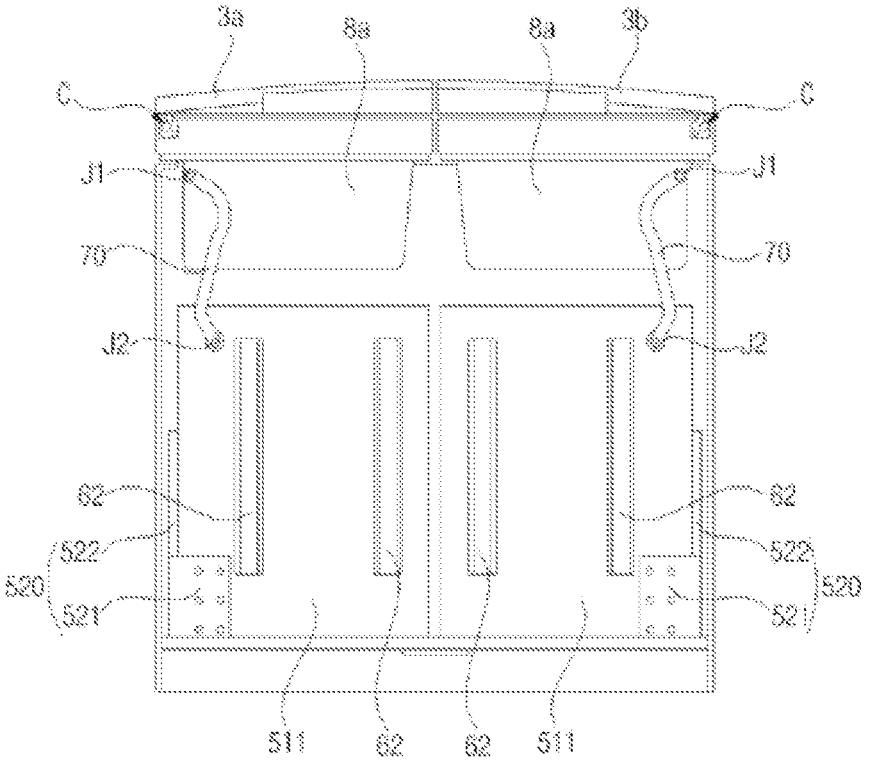
FIG. 19 is a view showing the refrigerating compartment when viewed from below, particularly showing a structure in which the door and a horizontal plate are connected to each other via the link.
Figure 20:
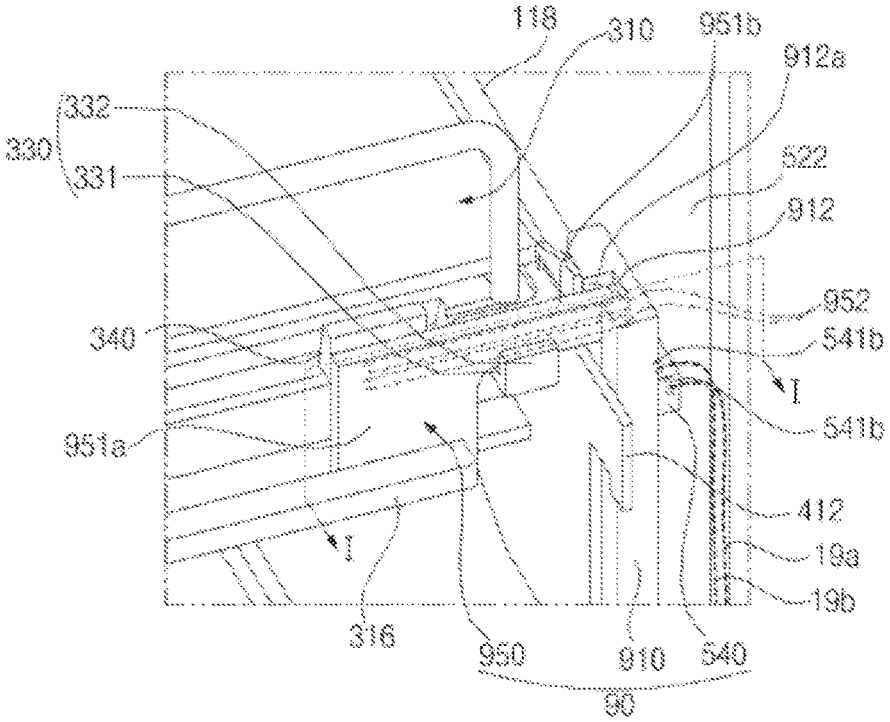
FIG. 20 is a view showing a structure in which a shelf and a vertical part of the side plate are connected to each other via an interlocking unit.
Figure 21:
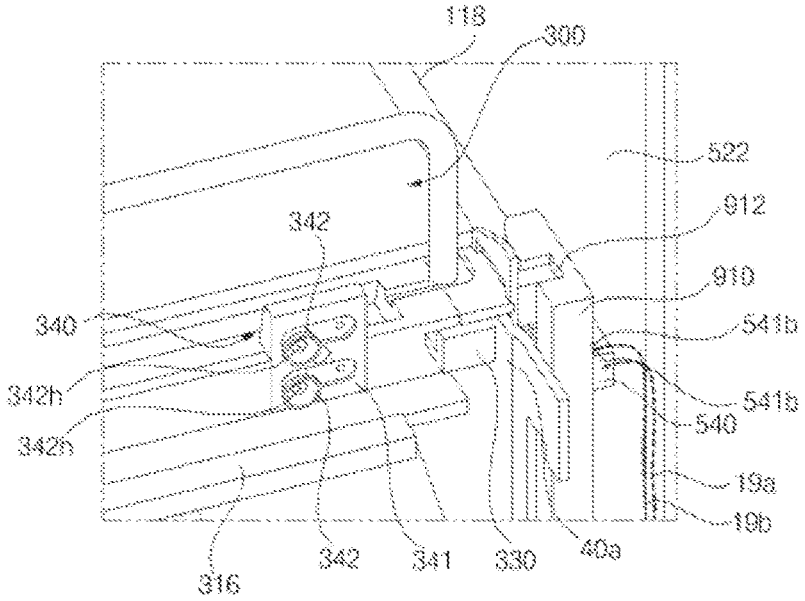
FIG. 21 is a view showing the structure of FIG. 20, from which a slide interlocking member is removed.
Figure 22:
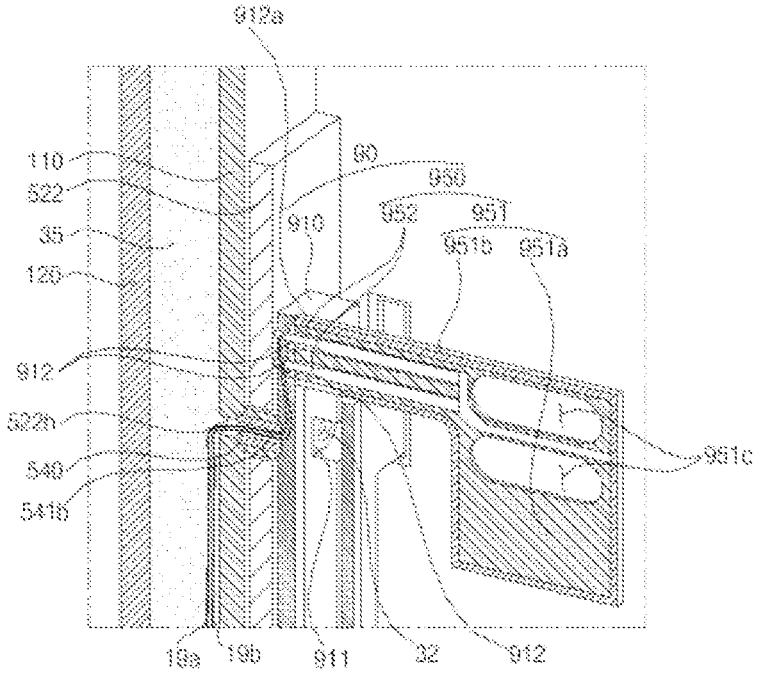
FIG. 22 is a sectional view taken along line I-I of FIG. 20.
Figure 23:
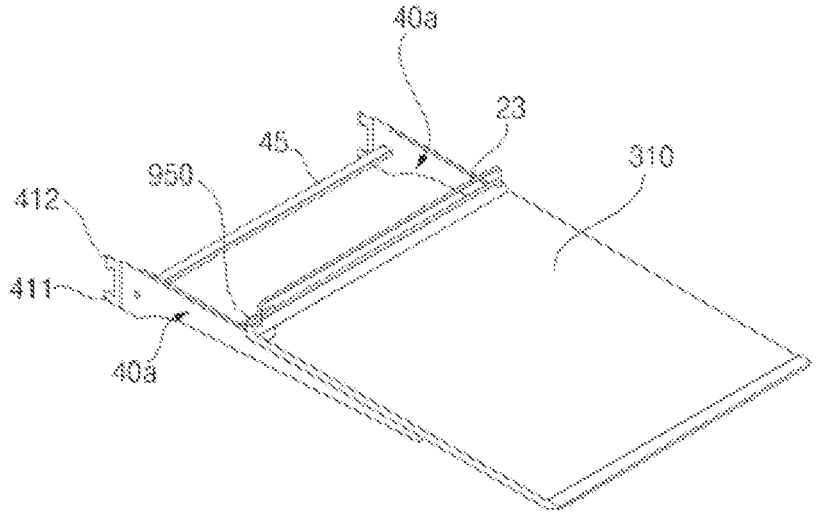
FIG. 23 is a perspective view showing an assembly of the shelf and cantilevers.
Figure 24:
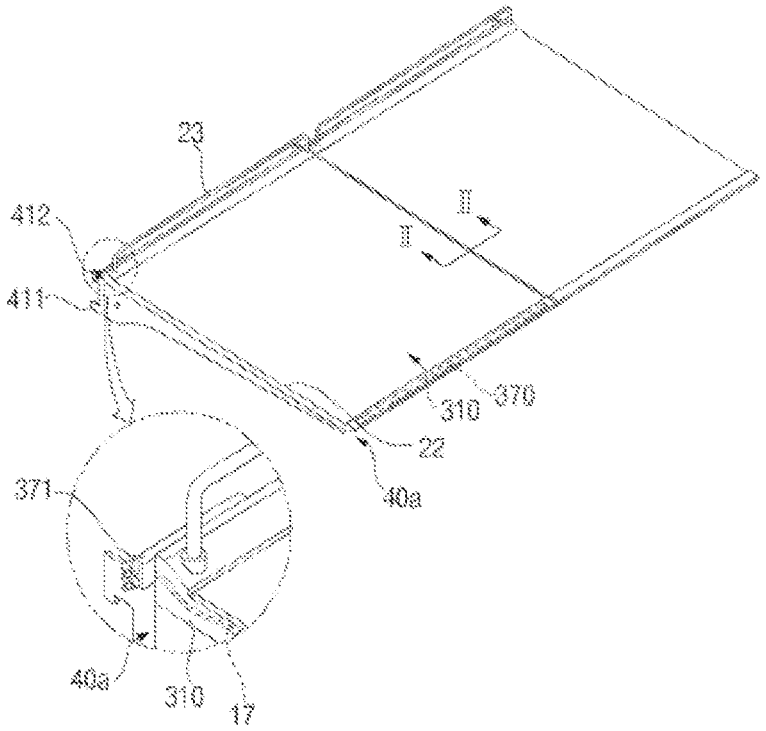
FIG. 24 is a perspective view showing an assembly of shelves provided at left and right sides in the refrigerating compartment.
Figure 25:
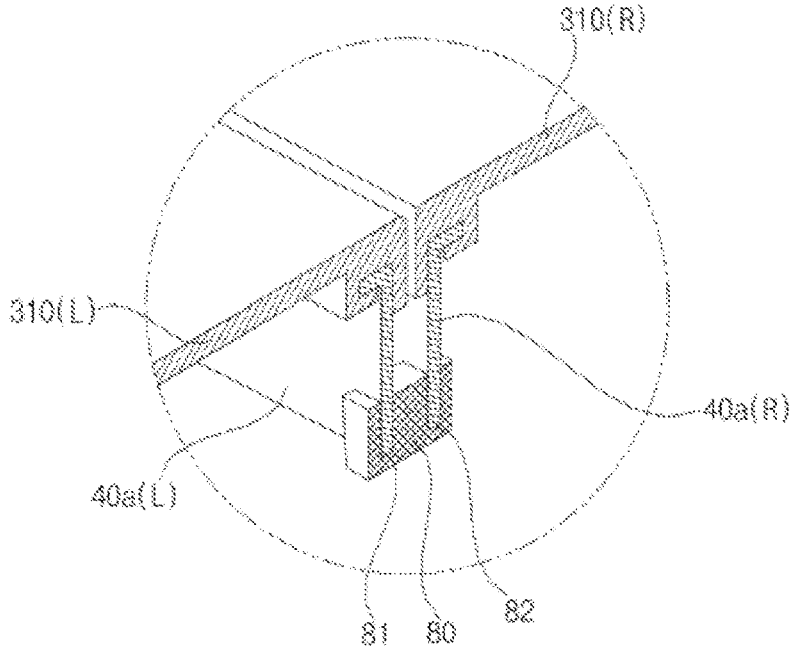
FIG. 25 is a sectional view taken along line II-II of FIG. 24.

FIG. 11 is a cutaway view showing a refrigerating compartment RC of a refrigerator 1*g* according to a seventh embodiment of the present invention. FIG. 12 is a front view showing a left refrigerating storage compartment S1 of the refrigerating compartment RC of FIG. 11. FIG. 13 is a view showing an assembly of a frame 50 and drawers 310, 320*a*, and 320*b* shown in FIGS. 11 and 12. FIG. 14 is a view showing the assembly shown in FIG. 13, from which the drawers 310, 320*a*, and 320*b* are removed. FIG. 15 is a view showing the state in which a middle interlocking member 910 is connected to a side plate 520. FIG. 16 is an enlarged sectional view showing part A of FIG. 12. FIG. 17 is a view showing a structure in which a door 3*a* and a base part 510 are connected to each other via a link 70. FIGS. 18A and 18B are a view showing the middle interlocking member 910, wherein FIG. 18A is a front view of the middle interlocking member 910 and FIG. 18B is a rear view of the middle interlocking member 910. FIG. 19 is a view showing the refrigerating compartment RC when viewed from below, particularly showing a structure in which the door 3*a* and a horizontal plate 511 are connected to each other via the link 70. FIG. 20 is a view showing a structure in which a shelf 310 and a vertical part 522 of the side plate 520 are connected to each other via an interlocking unit 90. FIG. 21 is a view showing the structure of FIG. 20, from which a slide interlocking member 950 is removed. FIG. 22 is a sectional view taken along line I-I of FIG. 20. FIG. 23 is a perspective view showing an assembly of the shelf 310 and cantilevers 40*a*. FIG. 24 is a perspective view showing an assembly of the shelf 310(L) or 310(R), provided at left and right sides in the refrigerating compartment RC. FIG. 25 is a sectional view taken along line II-II of FIG. 24. Hereinafter, the refrigerator according to the seventh embodiment will be described with reference to FIGS. 11 and 25.

In the following description, the term "storage compartment" means the refrigerating compartment RC of the refrigerator 100 shown in FIG. 2. However, the present invention is not limited thereto. The storage compartment may be the refrigerating compartment or the freezing compartment. In the case in which one compartment is partitioned into two storage compartments arranged in the horizontal direction, the term "storage compartment" may mean one of the partitioned storage compartments. In other embodiments, the entirety of one compartment (i.e. one refrigerating compartment or one freezing compartment) may constitute a single storage compartment.

A cabinet 10 may include an inner cabinet 110 and an outer cabinet 120. The outer cabinet 120 is disposed outside the inner cabinet 110. A predetermined space may be defined between the outer cabinet 120 and the inner cabinet 110. The space may be filled with an insulating material 35 (see FIG. 16).

Drawers D may be disposed in the refrigerating compartment RC. A plurality of drawers D may be arranged in the upward-downward direction. In this embodiment, four drawers D are disposed in the left refrigerating storage compartment S1 so as to be arranged in the upward-downward direction. Two upper ones of the drawers D are shelves 310, each of which is supported by a pair of cantilevers 40*a*, and two lower ones of the drawers D are containers 320*a* and 320*b*, which are supported by the base part 510 constituting the frame 50.

A bar 45 may be provided so as to maintain a uniform distance between a pair of cantilevers 40*a* configured to support each shelf 310. The bar 45 may be disposed between a pair of cantilevers 40*a* configured to support each shelf 310. One end of the bar 45 may be connected to one of the cantilevers 40*a*, and the other end of the bar 45 may be connected to the other of the cantilevers 40*a*.

The cantilevers 40*a* are disposed in the refrigerating compartment RC to support the shelves 310 so as to be movable in the forward-rearward direction. The rear ends of the cantilevers 40*a* may be coupled to a rear wall 113 of the inner cabinet 110, and the cantilevers 40*a* may extend horizontally from the rear ends thereof toward an open front surface of the refrigerating compartment RC.

The rear wall 113 of the inner cabinet 110, which defines a rear surface S(r) of the refrigerating compartment RC, may be provided with a plurality of slots 115, which are arranged in the upward-downward direction, and the cantilevers 40*a* may be separably coupled into one or more fastening holes 115.

Referring to FIGS. 23 and 24, a pair of fastening protrusions 411 and 412 may be formed at the rear end of each cantilever 40*a*. The fastening protrusions 411 and 412 may be coupled into the slots 115. The slots 115 may be arranged at predetermined intervals. Hereinafter, the lower one of the slots 115 coupled to each cantilever 40*a* will be referred to as a first slot 115*a*, and the upper one of the slots 115 will be referred to as a second slot 115*b* (see FIG. 12).

The lower one of the fastening protrusions 411 and 412, i.e. the first fastening protrusion 411, extends straight rearward from each cantilever 40*a* so as to freely pass through the first slot 115*a* in the forward-rearward direction. The second fastening protrusion 412 is formed in a hook shape, in which the end of the second fastening protrusion 412 is bent downward. In the state in which the second fastening protrusion 412 is inserted into the second slot 115*b*, therefore, the second fastening protrusion 412 is caught by the edge of the second slot 115*b*. Consequently, the cantilevers 40*a* are not separated from the rear wall 113 even when the cantilevers 40*a* are pulled in the forward direction after the cantilevers 40*a* are mounted to the rear wall 113.

Each shelf 310 may be provided with a support bar 23. The support bar 23 is provided to prevent food or containers placed on each shelf 310 from falling from the shelf 310 when the food or the containers fall over. The support bar 23 may be constituted by a rigid bar having a predetermined diameter, which is bent in an "n" shape. The support bar 23 may be located upright on the upper surface of each shelf 310. Alternatively, a support member formed in a plate shape having a predetermined height and a width corresponding to the width of each shelf 310 may be mounted upright to the rear of the upper surface of each shelf 310.

The cantilevers 40*a* may support the bottom surface of each shelf 310. Each shelf 310 may be formed in the shape of a quadrangular plate. Each shelf 310 may be supported by a pair of cantilevers 40*a*. Correspondingly, the slots 115 may also be arranged in two lines.

Each shelf 310 may be supported by the cantilevers 40*a* in a state of static mechanical equilibrium. That is, the entire load of each shelf 310 is supported by the cantilevers 40*a*. Each shelf 310 remains stationary on the cantilevers 40*a* unless external force is applied to the shelf 310.

Referring to FIGS. 12 to 14, the frame 50 may include a base part 510 and a side plate 520. The base part 510 may include a horizontal plate 511 disposed at the lower side of the container 320*b* (i.e. the lower side of the lowermost one 320*b* of the drawers). The side plate 520 may be coupled to the horizontal plate 511.

Referring to FIGS. 14, 17, and 19, the frame 50 may be connected to the door 3*a* via the link 70. Consequently, the frame 50 may be moved in response to the turning of the door 3*a*. When the door 3*a* is opened, the link 70 pulls the frame 50 in the forward direction, with the result that the frame 50 is moved in the forward direction. On the other hand, when the door 3*a* is closed, the link 70 pushes the frame 50 in the rearward direction, with the result that the frame 50 is moved in the rearward direction. The link 70 may be disposed at the lower side of the horizontal plate 511 such that the rear end of the link 70 is connected to the bottom surface of the horizontal plate 511.

One end of the link 70 is turnably connected to the door 3*a*, and the other end of the link is turnably connected to the horizontal plate 511 of the base part 510. Consequently, the link 70 may move the base part 510 in response to the turning of the door 3*a*. At this time, the side plate 520 is moved together with the base part 510, with the result that the shelves 310 connected to the side plate 520 are also moved by the interlocking units 90 (see FIG. 20), a description of which will follow.

In the state in which the door 3*a* is fully open, i.e. in the state in which the frame 50 is maximally withdrawn in the forward direction by the link 70, the shelves 310 do not pass over the front surface of the refrigerating compartment RC. However, the movable range of the shelves 310 that is allowed by the cantilevers 40*a* is not limited such that the shelves 310 do not pass over the front surface of the refrigerating compartment RC. That is, in the state in which the door 3*a* is fully open, the shelves 310 are located at a position where the shelves 310 do not pass over the front surface of the refrigerating compartment RC. However, this means that the shelves 310 are automatically withdrawn to the final positions thereof by the frame 50, which is interlocked with the door 3*a*. Even in the state in which the door 3*a* is fully open, a user may further withdraw the shelves 310 manually. To this end, the cantilevers 40*a* may be configured to guide the movement of the shelves 310 such that the shelves 310 pass over the distance to which the shelves 310 are automatically withdrawn by the frame 50.

Referring to FIGS. 12, 14, and 16, the frame guide 60 may guide the base part 510 such that the base part 510 is movable in the forward-rearward direction. The frame guide 60 may be disposed between the horizontal plate 511 and the bottom surface S(b) of the storage compartment S1. The frame guide 60 may include a stationary rail 61 fixed to the bottom surface S(b) of the storage compartment S1 and extending in the forward-rearward direction and a moving rail 62 fixed to the bottom surface of the horizontal plate 511 so as to slide along the stationary rail 61 during the movement of the horizontal plate 511.

Referring to FIG. 17, the door 3*a* may be connected to the cabinet 10 via a hinge bracket 150. The hinge bracket 150 may include a cabinet coupling part 151 coupled to the front surface of the cabinet 10 (in this embodiment, the front surface of a horizontal partition 7), a door supporter 152 protruding forward from the cabinet coupling part 151, and a door connection shaft 153 extending from the door supporter 152 in the upward-downward direction so as to be turnably coupled to the door 3*a*.

The door 3*a* may include a horizontal surface that faces in the downward direction, and the door connection shaft 153 may be inserted into a shaft coupling hole 122, which is formed in the horizontal surface. The horizontal surface may define, for example a bottom surface 31 of the door 3*a*.

A front end 71 of the link 70 may be turnably coupled to the door 3*a* so as to constitute a first turning joint J1, and a rear end 72 of the link 70 may be turnably coupled to the horizontal plate 511 so as to constitute a second turning joint J2.

The first turning joint J1 is spaced apart from the center of turning of the door 3*a* with respect to the cabinet 10, i.e. a turning axis c of the door 3*a*, by a predetermined distance R. When the door 3*a* is turned, therefore, the first turning joint J1 moves along the circumference of a circle having a radius R about the turning axis c of the door 3*a*. Since the position of the first turning joint J1 is variable on the circumference of the circle, the second turning joint J2 is also displaced so as to move the base part 510.

The link 70 may include a first bent section 73 extending from the front end 71 and bent convexly in the direction away from the turning axis c of the door 3*a* and a second bent section 74 located between the first bent section 73 and the rear end 72 and bent convexly in the direction opposite the first bent section 73. Since the first turning joint J1 is turned about the turning axis c of the door 3*a* when the door 3*a* is opened, a portion of the link 70, particularly a part of the link 70 that is adjacent to the first turning joint J1, may interfere with the door 3*a*. Particularly, in the case in which the front end 71 of the link 70 is coupled to the door at a position higher than the lowermost end of the door 3*a*, as shown in FIG. 17, the link 70 may interfere with a portion of the door 3*a* that is located at a position higher than the lowermost end of the door 3*a* (e.g. a side edge 33 of the door 3*a*). In order to prevent interference between the link 70 and the door 3*a*, therefore, the first bent section 73, which is bent in the direction away from the turning axis c of the door 3*a*, is formed at a part of the link 70 that is adjacent to the front end 71.

As the second turning joint J2 approaches a side edge 511*a* of the horizontal plate 511, force applied to the horizontal plate 511 via the link 70 acts on a position distant from the center of the horizontal plate 511, with the result that eccentricity occurring in the direction traversing the direction in which the horizontal plate 511 is moved (i.e. the forward-rearward direction) is increased. For this reason, the rear end 72 of the link 70 may be spaced apart from the side edge 511*a* of the horizontal plate 511 by a predetermined distance or more. In response to the position of the rear end 72, the second bent section 74, which is bent convexly in the direction opposite the first bent section 73, is formed between the first bent section 73 and the rear end 72.

Referring to FIG. 14, the base part 510 may include a pair of support walls 512 and 513 extending upward from opposite side edges of the horizontal plate 511. The base part 510 has a receiving space defined by the horizontal plate 511 and the support walls 512 and 513. One or more containers 320*a* and 320*b* may be disposed in the receiving space. The receiving space is formed in the frame 50. Consequently, the receiving space is moved together with the frame 50 in response to the opening and closing of the door 3*a*.

The base part 510 is open between the front ends of the support walls 512 and 513. The containers 320*a* and 320*b* may be inserted into or withdrawn from the receiving space through the opening. In this embodiment, two containers 320*a* and 320*b* are received in the receiving space so as to be arranged in the upward-downward direction. The containers 320*a* and 320*b* are configured to be movable with respect to the base part 510. Consequently, a user may manually withdraw the containers 320*a* and 320*b* from the receiving space.

Referring to FIG. 16, container guides 590 for guiding the movement of the containers 320*a* and 320*b* may be disposed at the support walls 512 and 513. Each container may be supported by two container guides 590 disposed at the support walls 512 and 513.

The container guides 590 are fixed to the support walls 512 and 513. Each of the container guides 590 may include a stationary rail 591 extending in the forward-rearward direction and a roller 592 disposed at a corresponding one of the containers 320*a* and 320*b* so as to be moved along the rail 591. In other embodiments, the rollers 592 may be disposed at the support walls 512 and 513, and the rails 591, which are supported by the rollers 592, may be disposed at the containers 320*a* and 320*b*.

A plurality of containers 320*a* and 320*b* may be disposed in the receiving space so as to be arranged in the upward-downward direction. An appropriate number of container guides 590 may be provided depending on the number of containers 320*a* and 320*b*.

A cover shelf 27 may be further provided to define the upper side of the receiving space. The cover shelf 27 may be fixed in the storage compartment S1. The cover shelf 27 may be coupled to the rear wall 113 of the inner cabinet 110 (or the rear surface of the storage compartment S1). The cover shelf 27 may be provided in the bottom surface thereof with a pair of grooves 27*a* extending in the forward-rearward direction while being parallel to each other. During the movement of the frame 50, the upper ends of the support walls 512 and 513 may be guided along the grooves 27*a*.

Referring to FIG. 14, the side plate 520 may include a horizontal part 521 coupled to the horizontal plate 511 and a vertical part 522 bent from the horizontal part 521 and extending upward. When the vertical part 522 is cut along an arbitrary horizontal plane, the vertical part has a section that extends in the forward-rearward direction while being parallel to the side edge 511*a* of the horizontal plate 511.

In other embodiments, the side plate 520 may be formed from a single metal sheet. The metal sheet may be cut and bent according to the designed shape thereof to form the horizontal part 521 and the vertical part 522.

The forward-rearward length d1+d2 of the vertical part 522 may be shorter than the length of the side edge 511*a* of the horizontal plate 511. That is, the vertical part 522 does not necessarily have a length corresponding to the entire length of the side edge 511*a* of the horizontal plate 511. The vertical part 522 may have a length corresponding to a portion of the side edge 511*a* of the horizontal plate 511, particularly a portion of the horizontal plate 511 that is adjacent to the rear end (or the rear corner) thereof.

However, the forward-rearward length of the vertical part 522 may not be uniform at all heights. The vertical part 522 may include a vertical extension section 522*a* having a forward-rearward length d1 and extending upward from the horizontal part 521 and a horizontal protrusion section 522*b* horizontally protruding from the vertical extension section 522*a* in the forward or rearward direction by a length d2.

A plurality of horizontal protrusion sections 522*b* may be formed at different heights so as to be parallel to each other. In this embodiment, three horizontal protrusion sections 522*b* are formed. Two upper ones of the horizontal protrusion sections 522*b* are formed at heights corresponding to the cantilevers 40*a*. At the horizontal protrusion sections 522*b*, the forward-rearward length of the vertical part 522 is increased. During the movement of the frame 50, therefore, the vertical part 522 may be more able to withstand the repulsive force from the shelves 310.

The interlocking unit 90 (see FIG. 20) may be disposed in the refrigerating compartment RC to interconnect the vertical part 522 and the shelf 310 such that the shelf 310 is interlocked with the side plate 520. The interlocking unit 90 may include a connection mount 540, a middle interlocking member 910, and a slide interlocking member 950.

The connection mount 540 is a member, to which the middle interlocking member 910 is coupled. The connection mount 540 may be fixed to the vertical extension section 522*a*. The connection mount 540 may protrude from the vertical extension section 522*a* toward the shelf 310. The connection mount 540 may be formed in the shape of a shell protruding from the vertical extension section 522*a* to define a predetermined space between the connection mount 540 and the vertical extension section 522*a*. The connection mount 540 may be provided with a plurality of through holes 541*a* and 541*b*, which are formed through the shell. At least one of the through holes 541*a* and 541*b* may be used to guide power supply cables 19*a* and 19*b* to sockets 912 formed in the middle interlocking member 910, a description of which will follow.

After passing through the through holes 541*b*, which are formed in the connection mount 540, the power supply cables 19*a* and 19*b* may be guided to the sockets 912 along power supply cable guide recesses 916 formed in one surface of the middle interlocking member 910 (see FIG. 8(*b*)).

Referring to FIG. 12, an interlocking unit guide slit 118, through which the connection mount 540 passes, is formed in the side wall 111 of the inner cabinet 110 so as to extend in the forward-rearward direction. The connection mount 540 is located in the interlocking unit guide slit 118, and the middle interlocking member 901 is coupled to the connection mount 540 in the refrigerating compartment RC.

The vertical extension section 522*a* may be provided at positions thereof corresponding to the through hole 541*b* with through holes 522*h*, through which the power supply cables 19*a* and 19*b* pass. The power supply cables 19*a* and 19*b*, which constitute a circuit for operating a lighting device 370 (see FIG. 24), may be electrically connected to connection terminals 952 inserted into the respective sockets 912, which are formed in the middle interlocking member 910, through the through holes 522*h*, which are formed in the vertical extension section 522*a*, and the through hole 541*b*, which is formed in the connection mount 540. The connection terminals 952 constitute the slide interlocking member 950, a detailed description of which will follow.

The middle interlocking member 910 interconnects the slide interlocking member 950 and the vertical part 522. The middle interlocking member 910 may be disposed between the cantilever 40*a* and the vertical part 522. The middle interlocking member 910 may be coupled to the connection mount 540. A plurality of connection mounts 540 may be provided in a number equal to the number of shelves 310 to be interlocked with the frame 50. In this embodiment, two connection mounts 540 are arranged in the upward-downward direction so as to correspond to two shelves 310. One middle interlocking member 910 may be coupled to a plurality of connection mounts 540.

Referring to FIGS. 18A and 18B, the middle interlocking member 910 may be provided in the rear surface thereof (i.e. the surface thereof opposite the side wall 111 of the inner cabinet 110 (see FIG. 18B) with coupling recesses 913, which are recessed so as to correspond to the connection mounts 540. The connection mounts 540 may be inserted into the coupling recesses 913. Each of the coupling recesses 913 may have therein fastening holes 911, which are formed at positions corresponding to the through holes 541*a* in a corresponding one of the connection mounts 540.

Fastening members 32 for coupling the middle interlocking member 910 to the vertical extension section 522*a* may be fastened into the fastening holes 911, which are formed in the middle interlocking member 910, and the through holes 541, which are formed in the connection mounts 540.

The middle interlocking member 910 may be provided in the rear surface thereof (i.e. the surface thereof opposite the side wall of the refrigerating compartment RC (see FIG. 8(*b*)) with coupling recesses 913, which are recessed so as to correspond to the connection mounts 540. The connection mounts 540 may be inserted into the coupling recesses 913. Consequently, portions of the front surface of the middle interlocking member 910 (see FIG. 8(*a*)) corresponding to the coupling recesses 913 protrude, and fastening holes 911 may be formed in the protruding portions.

The slide interlocking member 950 is mounted to the shelf 310 so as to be moved together with the shelf 310. The slide interlocking member 950 interconnects the shelf 310 and the middle interlocking member 910. The slide interlocking member 950 may be separably connected to the middle interlocking member 910. A user may connect a desired shelf 310 to the middle interlocking member 910 using the slide interlocking member 950.

Referring to FIGS. 20 to 22, the slide interlocking member 950 may be configured to be moved on the shelf 310 in the axial direction. Depending on the position thereof, the slide interlocking member 950 may be connected to or separated from the middle interlocking member 910.

The slide interlocking member 950 may include an interlocking member housing 951 and a pair of connection terminals 952 protruding from the interlocking member housing 951 in the lateral direction so as to be inserted into the sockets 912, formed in the middle interlocking member 910. The connection terminals 952 protrude from positions corresponding to the sockets 912. Depending on the position of the interlocking member housing 951, the connection terminals 952 may be inserted into or separated from the sockets 912.

The interlocking member housing 951 may include a housing body 951*a* and a connection protrusion 951*b* protruding from the housing body 951*a* in the lateral direction, i.e. toward the middle interlocking member 910. The connection protrusion 951*b* may protrude from a portion spaced apart upward from the lower end of the housing body 951*a*. The middle interlocking member 910 may be provided with an insertion recess 912*a*, into which the connection protrusion 951*b* is inserted. Depending on the position of the slide interlocking member 950 on the shelf 310, the connection protrusion 951*b* may be inserted into or separated from the insertion recess 912*a*.

The connection terminals 952 may protrude in the lateral direction further than the connection protrusion 951*b*. The connection terminals 952 may be located in the insertion recess 912*a*. As the connection protrusion 951*b* is inserted into the insertion recess 912*a*, the connection terminals 952 may be inserted into the sockets 912.

The slide interlocking member 950 may be mounted at the rear end of the shelf 310. The shelf 310 may be provided at the rear end thereof with a holder 330 for supporting the slide interlocking member 950. The slide interlocking member 950 may be moved in the lateral direction in the state of being supported by the holder 330.

More specifically, the holder 330 protrudes rearward from the rear surface of the shelf 310, and is formed in an "L" shape. The holder 330 may include a lower support plate 331 for supporting the connection protrusion 951*b* from below and a catching protrusion 332 extending upward from the lower support plate 331, the catching protrusion 332 being located at the rear of the connection protrusion 951*b*.

The shelf 310 may be provided with a rib 316 protruding upward from the surface thereof contacting the lower end of the housing body 951*a* so as to extend in the direction in which the slide interlocking member 950 is moved (i.e. the lateral direction) and to be located at the rear of the housing body 951*a*. The rearward movement of the housing body 951*a* is blocked by the rib 316.

Referring to FIG. 21, an interlocking member guide 340 may protrude from the rear surface of the shelf 310. The interlocking member guide 340 may include a guide body 341 coupled to the shelf 310 and a guide protrusion 342 protruding from the guide body 341. A pair of guide protrusions 342 may be arranged in the upward-downward direction.

Referring to FIG. 22, the slide interlocking member 950 may be provided in the front surface thereof with protrusion insertion recesses 951*c*, into which the guide protrusions 342 are inserted. The protrusion insertion recesses 951*c* may be formed so as to correspond to the guide protrusions 342.

The protrusion insertion recesses 951*c* may be longer than the width (or the outer diameter) of the guide protrusions 342 such that the slide interlocking member 950 is moved in the lateral direction in the state in which the guide protrusions 342 are inserted into the protrusion insertion recesses 951*c*.

Each guide protrusion 342 may be formed in the shape of a pipe having a hollow part 342*h* extending in the longitudinal direction. Electric wires 17 (see FIG. 24), which are electrically connected to the connection terminals 952, may be electrically connected to an electric part mounted on the shelf 310 through the hollow parts 342*h*.

The electric part may be a lighting device 370 (see FIG. 24) provided on the shelf 310. The lighting device 370 may include a light source (e.g. an LED) that emits light when powered on. The lighting device 370 may be disposed at the front end of the shelf 310. The light source may be connected to the electric wires 17 extending through the hollow parts 342*h* of the guide protrusions 342.

The lighting device 370 may be mounted to the front end of the shelf 310 to emit light downward. In the case in which a plurality of shelves 310 is arranged in the upward-downward direction, as in this embodiment, the lighting device 370 may be provided at each of the shelves 310. The lighting device 370 provided at the upper shelf 310 may emit light toward the lower shelf 310. In general, fixed lighting devices (not shown) are provided in the refrigerating compartment RC and the freezing compartment FC so as to be turned on when the doors 3*a*, 3*b*, 3*c*, and 3*d* are opened and turned off when the doors are closed. In addition, the lighting devices 370 are further mounted to the shelves 310 such that food placed on the shelves looks fresher when the shelves 310 are withdrawn. In particular, it is difficult to provide sufficient luminosity using the fixed lighting devices if the size of the compartments RC and FC is large. In this case, sufficient luminosity may be provided by the lighting devices 370, which are additionally mounted to the shelves 310.

Referring to FIGS. 24 and 25, shelves 310 may be provided in the storage compartments defined in each of the compartments RC and FC. Hereinafter, a first shelf 310(L) disposed in the left refrigerating storage compartment S1 defined in the refrigerating compartment RC and a second shelf 310(R) disposed in the right refrigerating storage compartment S2 defined in the refrigerating compartment RC will be described by way of example.

The first shelf 310(L) and the second shelf 310(R) are disposed at the same height. Each of the first shelf 310(L) and the second shelf 310(R) is supported by a pair of cantilevers 40*a*. As previously described, the first shelf 310(L) may be automatically withdrawn by the frame 50 interlocked with the door 3*a*. In other embodiments, another frame 50 interlocked with the door 3*a* may be further provided to automatically withdraw the second shelf 310(R). The frame 50 moves the shelf 310(L) or 310(R) via the interlocking unit 90. The interlocking unit 90 connects the vertical part 522 of the frame 50 to the shelf 310(L) or 310(R). Consequently, forward or rearward pushing force applied to the shelf 310(L) or 310(R) via the interlocking unit 90 is concentrated on the side of the shelf 310(L) or 310(R) adjacent to the vertical part 522. That is, force is not uniformly applied to opposite sides of the shelf 310(L) or 310(R), but is concentrated on one side of the shelf 310(L) or 310(R). As a result, the shelf 310(L) or 310(R) may shake when the shelf 310(L) or 310(R) is moved by the frame 50. In particular, force may not be uniformly applied to two cantilevers 40*a* that support one shelf (e.g. the shelf 310(L)), with the result that the cantilevers 40*a* may shake, or the shelf 310(L) or 310(R), guided along the cantilevers 40*a*, may not move smoothly. In order to solve the above problem, a fixing bracket 80 may be provided to hold one 40*a*(L) of the two cantilevers 40*a* that support the first shelf 310(L) and a corresponding one 40*a*(R) of the two cantilevers 40*a* that support the second shelf 310(R) while maintaining a uniform distance therebetween.

The fixing bracket 80 may be provided with a first insertion recess 81, into which the lower end of the first cantilever 40*a*(L) that supports the first shelf 310(L) is inserted, a second insertion recess 82, into which the lower end of the second cantilever 40*a*(R) that supports the second shelf 310(R) is inserted. The first insertion recess 81 and the second insertion recess 82 are spaced apart from each other by the distance between the first cantilever 40*a*(L) and the second cantilever 40*a*(R). The insertion recesses 81 and 82 may extend in the longitudinal direction of the cantilevers 40*a*(L) and 40*a*(R).

Figure 26:
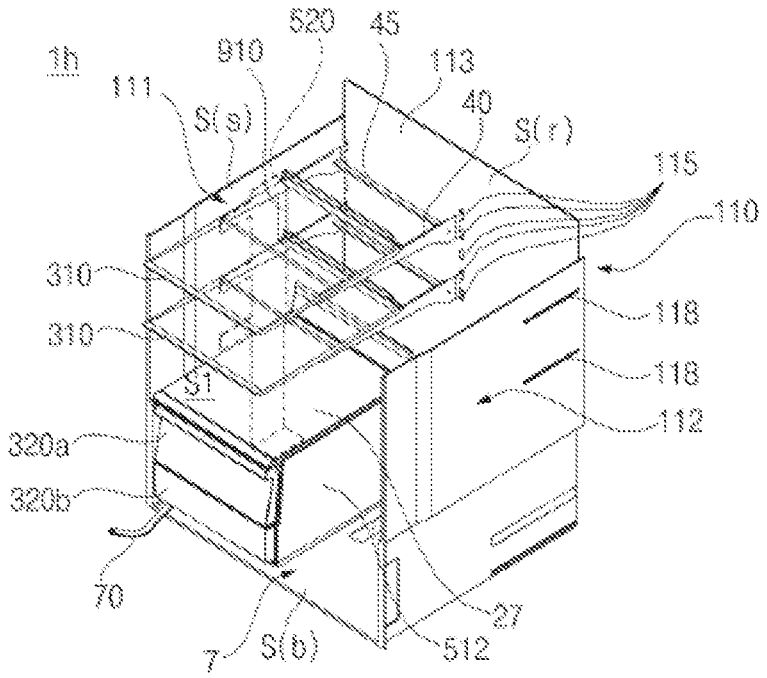
FIG. 26 is a cutaway view showing a refrigerating compartment of a refrigerator according to an eighth embodiment of the present invention.
Figure 27:
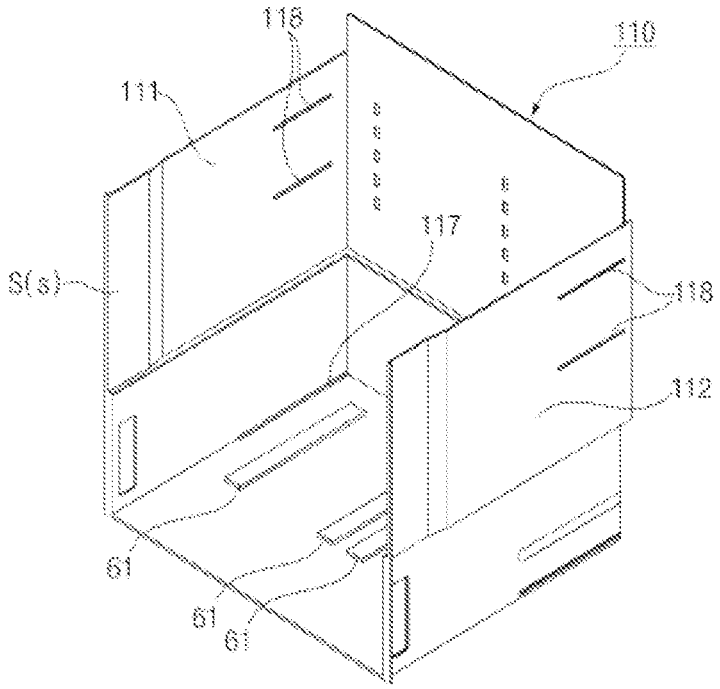
FIG. 27 is a view showing a portion of an inner cabinet shown in FIG. 26.
Figure 28:
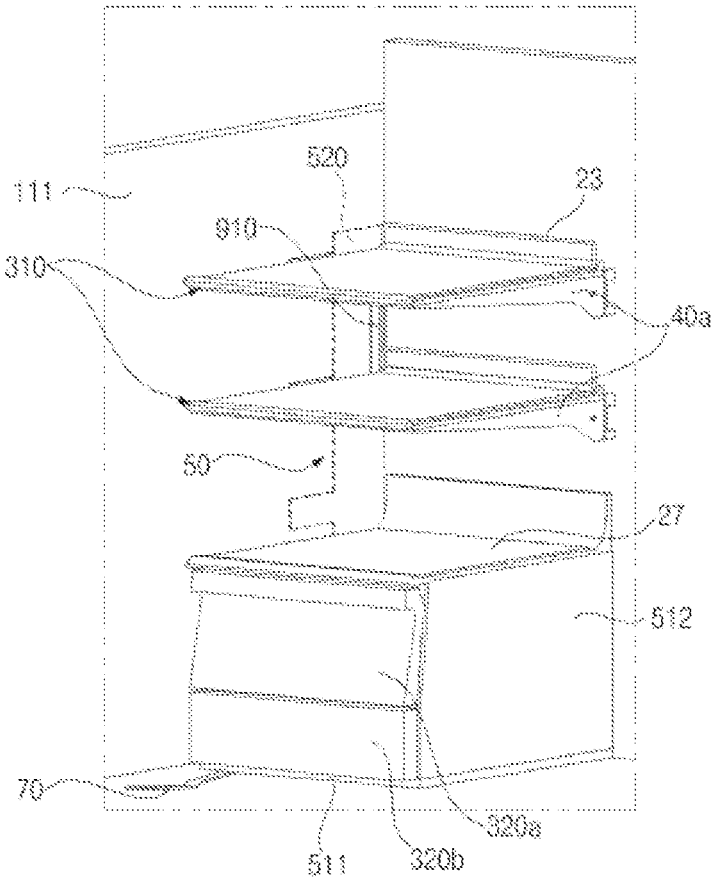
FIG. 28 is a view showing an assembly of a frame and drawers provided in the inner cabinet.
Figure 29:
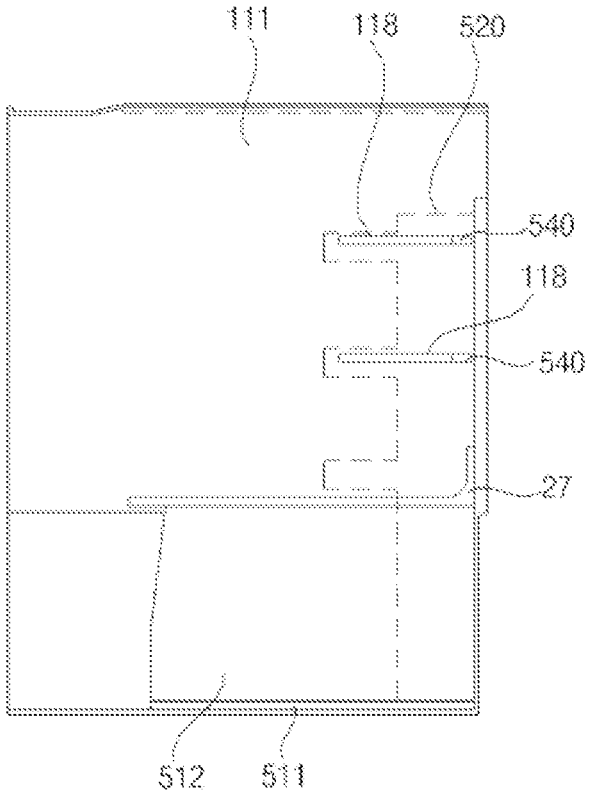
FIG. 29 is a view showing the interior of the refrigerating compartment when viewed in the lateral direction.
Figure 30:
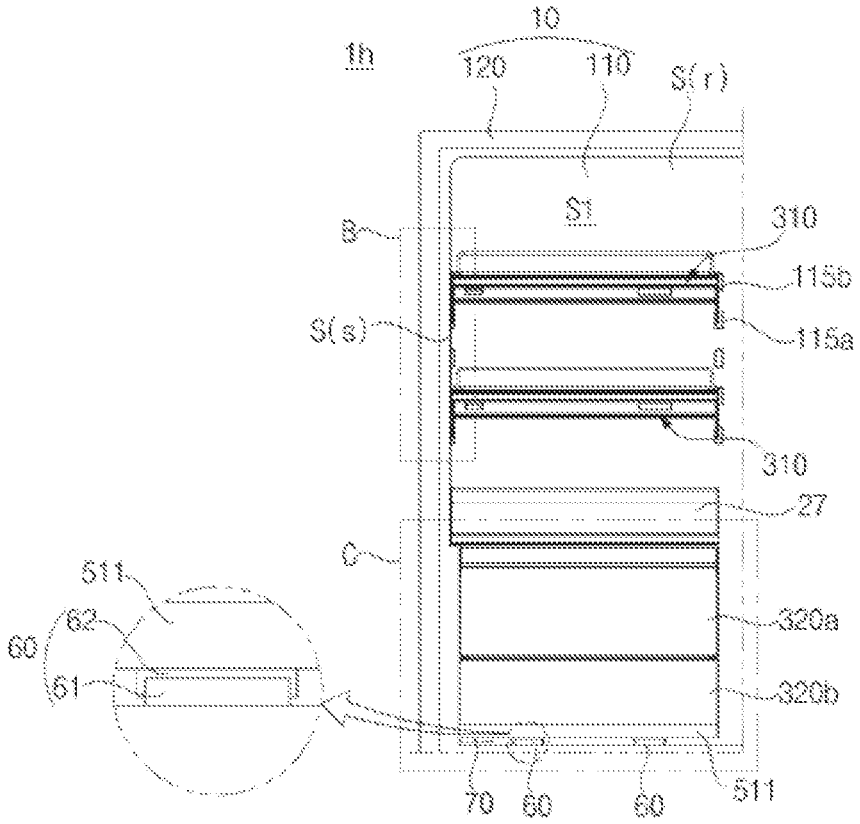
FIG. 30 is a view showing a left refrigerating storage compartment of the refrigerating compartment when viewed from the front.
Figure 31:
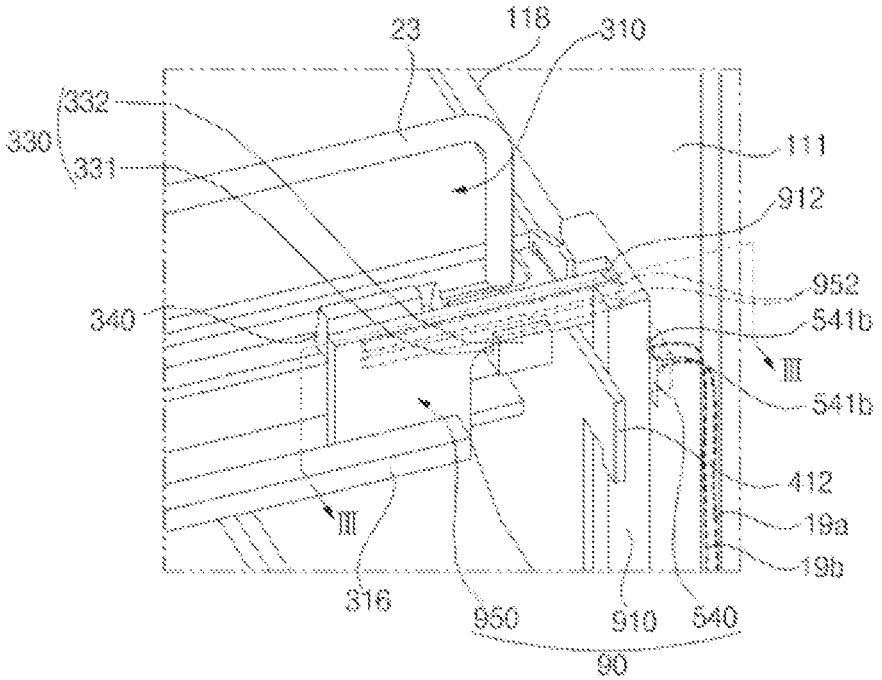
FIG. 31 is a view showing a structure in which the shelf and a vertical part of a side plate are connected to each other via an interlocking unit.
Figure 32:
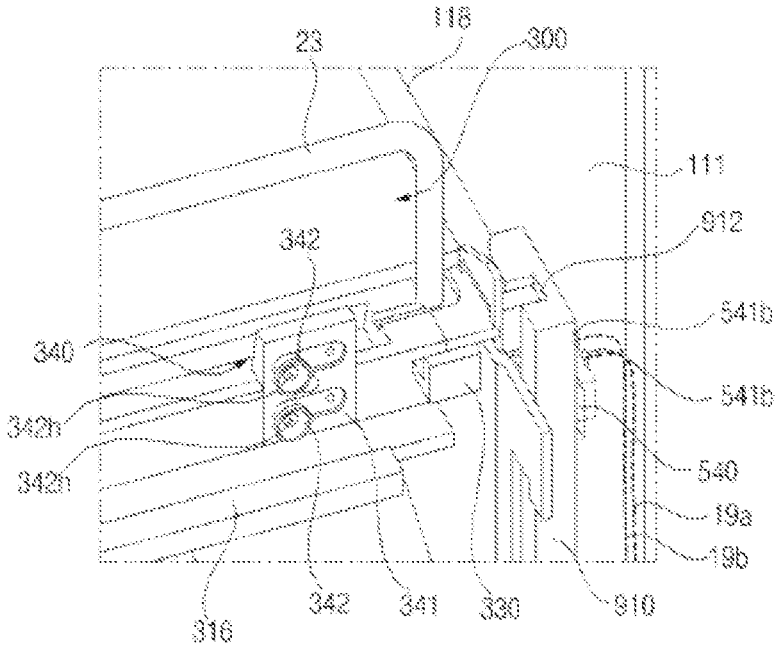
FIG. 32 is a view showing the structure of FIG. 31, from which a slide interlocking member is removed.
Figure 33:
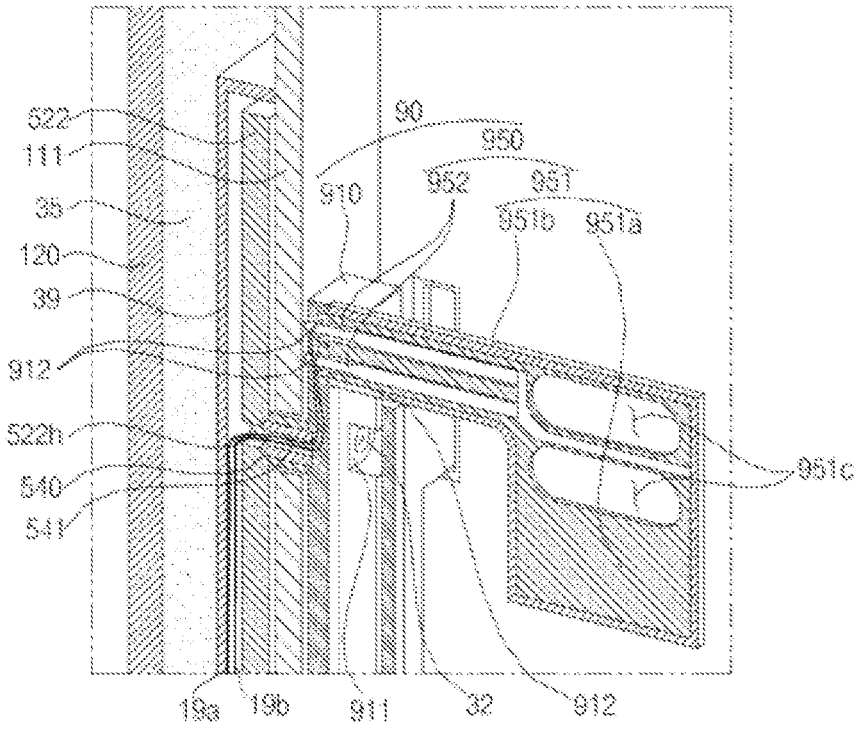
FIG. 33 is a sectional view taken along line III-III of FIG. 31.
Figure 34:
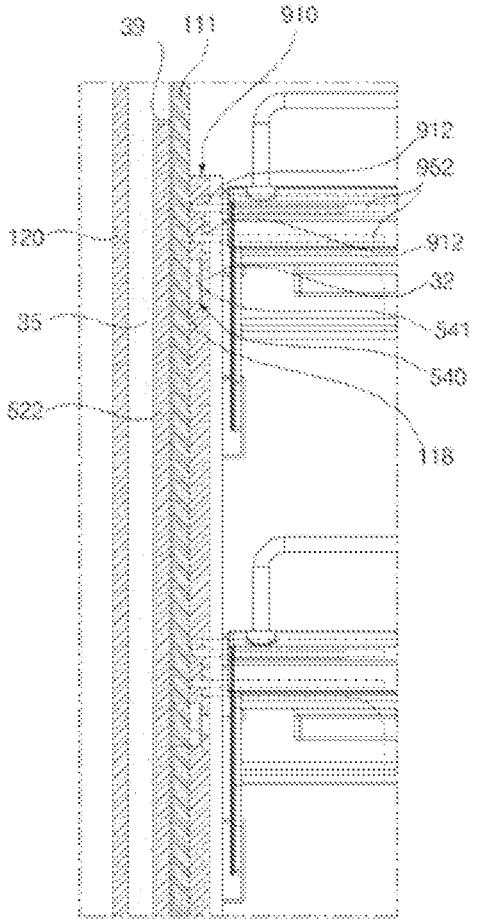
FIG. 34 is an enlarged sectional view showing part B of FIG. 30.
Figure 35:
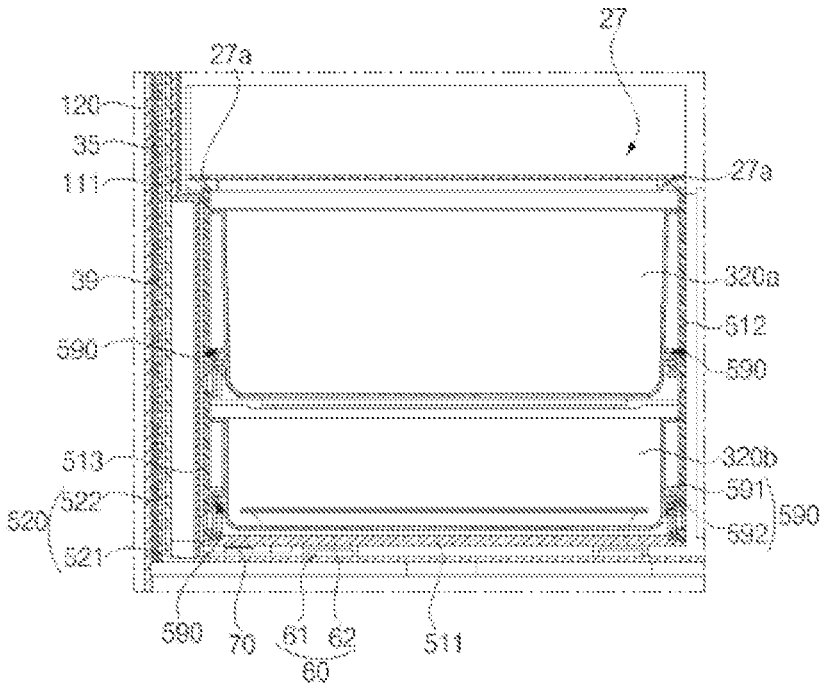
FIG. 35 is an enlarged sectional view showing part C of FIG. 30.

FIG. 26 is a cutaway view showing a refrigerating compartment RC of a refrigerator 1*h* according to an eighth embodiment of the present invention. FIG. 27 is a view showing a portion of an inner cabinet 110 shown in FIG. 26. FIG. 28 is a view showing an assembly of a frame 50 and drawers 310, 320*a*, and 320*b* provided in the inner cabinet 110. FIG. 29 is a view showing the interior of the refrigerating compartment S1 when viewed in the lateral direction. FIG. 30 is a view showing a left refrigerating storage compartment S1 of the refrigerating compartment RC when viewed from the front. FIG. 31 is a view showing a structure in which the shelf 310 and a vertical part 522 of a side plate 520 are connected to each other via an interlocking unit 90. FIG. 32 is a view showing the structure of FIG. 31, from which a slide interlocking member 950 is removed. FIG. 33 is a sectional view taken along line III-III of FIG. 31. FIG. 34 is an enlarged sectional view showing part B of FIG. 30. FIG. 35 is an enlarged sectional view showing part C of FIG. 30. Hereinafter, the refrigerator according to the eighth embodiment will be described with reference to FIGS. 26 to 35. Elements of this embodiment that are identical to those of the previous embodiment are denoted by the same reference symbols, and a description thereof will be omitted. In particular, the refrigerator 1*h* according to this embodiment is different from the refrigerator 1*g* according to the previous embodiment in that a vertical part 522 is disposed between an inner cabinet 110 and an outer cabinet 120. The other elements of the refrigerator according to this embodiment are identical to those of the refrigerator 1*g* according to the previous embodiment except for structural changes due to the above difference. Hereinafter, therefore, a description will be given based only on the difference between the refrigerator according to this embodiment and the refrigerator 1*g* according to the previous embodiment.

A cabinet 10 may include an inner cabinet 110 and an outer cabinet 120. The outer cabinet 120 is disposed outside the inner cabinet 110. A predetermined space may be defined between the outer cabinet 120 and the inner cabinet 110. The space may be filled with an insulating material 35 (see FIG. 33). In particular, a space between side walls 111 and 112 of the inner cabinet 110 and the outer cabinet 120 may be utilized as a space in which a side plate 520 is mounted and moved.

Referring to FIGS. 26 to 29, the frame 50 may include a base part 510 and a side plate 520. The base part 510 may include a horizontal plate 511 disposed at the lower side of the container 320 (i.e. the lower side of the lowermost one 320*b* of the drawers). The side plate 520 may be coupled to the horizontal plate 511. The side plate 520 may include a horizontal part 521 coupled to the horizontal plate 511 and a vertical part 522 bent from the horizontal part 521 and extending upward.

Frame guide slits 117, through which the horizontal part 521 of the side plate 520 passes, may be formed in the side walls 111 and 112 of the inner cabinet 110. The frame guide slits 117 may be longer than the forward-rearward length of the horizontal part 521 such that the horizontal part 521 can move in the frame guide slits 117 in the forward-rearward direction when the frame 50 is moved by a link 70.

Referring to FIGS. 27, 29, and 31 to 34, the side wall 111 of the inner cabinet 110 may be provided with interlocking unit guide slits 118, through which connection mounts 540 pass. The interlocking unit guide slits 118 may extend in the forward-rearward direction. The connection mounts 540 are located in the interlocking unit guide slits 118, and a middle interlocking member 910 is coupled to the connection mounts 540 in the refrigerating compartment RC.

Force for moving the frame 50 is applied to the frame 50 via a second turning joint J2 (see FIG. 17). Since the second turning joint J2 is turned about a first turning joint J1, the direction of resultant force applied to the frame via the second turning joint J2 is changed during turning of the door 3*a*, and the component of the resultant force in the forward-rearward direction moves the frame 50. In other words, the resultant force is applied not only in the direction in which the frame 50 is moved but also in a direction that intersects the direction in which the frame 50 is moved. As a result, the frame 50 may shake. Consequently, the connection mounts 540, which are formed at the vertical part 522, are located in the interlocking unit guide slits 118 such that the connection mounts 540 are moved while being supported by the interlocking unit guide slits 118 during the movement of the frame 50, thereby reducing shake of the frame 50.

Referring to FIGS. 31 to 33, the interlocking unit 90 may include a connection mount 540, a middle interlocking member 910, and a slide interlocking member 950. The connection mount 540 is a member, to which the middle interlocking member 910 is coupled. The connection mount 540 may be fixed to the vertical extension section 522*a*. The connection mount 540 may protrude from the vertical extension section 522*a* toward the shelf 310.

Since the vertical part 522 is disposed outside the inner cabinet 110, the connection mount 540 is inserted into the interlocking unit guide slit 118 from outside the inner cabinet 110.

The connection mount 540 may be connected to the connection mount 540 inside the inner cabinet 110, i.e. in the storage compartment S1. After passing through the through holes 522*h*, which are formed in the vertical extension section 522*a*, a pair of power supply cables 19*a* and 19*b* may pass through the through holes 541*b*, which are formed in the connection mount 540 located in the interlocking unit guide slit 118, may extend to the middle interlocking member 910, which is disposed inside the storage compartment S1, and may be guided to the sockets 912 along the power supply cable guide recesses 916 formed in one surface of the middle interlocking member 910 (see FIG. 8(*b*)).

When comparing FIGS. 31 and 32 with FIGS. 20 and 21, there is a difference in that since the vertical part 522 of the side plate 520 is located between the side wall 111 of the inner cabinet 110 and the outer cabinet 120, the connection mount 540 fixed to the vertical extension section 522*a* is connected to the slide interlocking member 950 via the interlocking unit guide slit 118, which is formed in the side wall 111 of the inner cabinet 110.

Due to the above difference, however, as shown in FIG. 33, the power supply cables 19*a* and 19*b* pass through the through holes 522*h*, which are formed in the vertical extension section 522*a*, between the side wall of the inner cabinet 110 and the outer cabinet 120, pass through the through holes 541*b*, which are formed in the connection mount 540 located in the interlocking unit guide slit 118, and are electrically connected to the connection terminals 952, which are inserted into the sockets 912 formed in the middle interlocking member 910.

Meanwhile, referring to FIG. 34, a guide cover 36 for surrounding the vertical part 522 may be provided at the outer surface of the side wall 111 of the inner cabinet 110 in order to prevent interference between the vertical part 522 and the insulating material 35 during the movement of the vertical part 522. The guide cover 36 may sufficiently extend in the forward-rearward direction such that contact between the vertical part 522 and the insulating material 35 is prevented over the entire range in which the vertical part 522 is moved by the link 70.

Those skilled in the art to which the present invention pertains will appreciate that the present invention may be carried out in specific ways other than those set forth herein without departing from the spirit and essential characteristics of the present invention. The above embodiments are therefore to be construed in all aspects as illustrative and not restrictive. The scope of the invention should be determined by the appended claims and their legal equivalents, not by the above description, and all changes coming within the meaning and equivalency range of the appended claims are intended to be embraced therein.

What is claimed is:

1. A refrigerator comprising:

a cabinet that has an opening and that defines a storage compartment;

a door hinged to the cabinet and configured to open and close at least a portion of the opening;

a cantilever mounted on a rear wall of the storage compartment;

a shelf supported on the cantilever and configured to move forward toward the opening of the cabinet and rearward toward the rear wall of the storage compartment;

a side plate supported on a side wall of the storage compartment and configured to move forward toward the opening of the cabinet and rearward toward the rear wall of the storage compartment;

an interlocking unit that connects the shelf to the side plate;

a horizontal plate that is connected to the side plate, that is supported on a bottom wall of the storage compartment, and that is configured to move forward toward the opening of the cabinet and rearward toward the rear wall of the storage compartment; and a link that connects the horizontal plate to the door, the link being configured to, based on the door being moved to an open position, cause the shelf to move forward toward the opening of the cabinet.

2. The refrigerator according to claim 1, wherein the cabinet comprises an inner cabinet that defines the storage compartment and an outer cabinet disposed outside of the inner cabinet;

wherein the side wall of the storage compartment is a side wall of the inner cabinet; and wherein the side plate comprises a vertical part disposed between the side wall of the inner cabinet and the outer cabinet.

3. The refrigerator according to claim 2, further comprising a frame guide slit in the side wall of the inner cabinet that extends horizontally in a front-rear direction of the storage compartment, wherein the side plate comprises a horizontal part that connects the horizontal plate and the vertical part through the frame guide slit.

4. The refrigerator according to claim 3, further comprising an interlocking guide slit in the side wall of the inner cabinet that is located above the frame guide slit and that extends parallel to the frame guide slit, wherein the interlock unit connects the shelf to the vertical part through the interlocking guide slit to lock the shelf with the horizontal plate.

5. The refrigerator according to claim 4, wherein the vertical part includes a protrusion fastening hole, and the interlocking unit comprises a connection protrusion that is disposed on the shelf, the connection protrusion being inserted into or separated from the protrusion fastening hole through the interlocking guide slit depending on a position of the connection protrusion.

6. The refrigerator according to claim 5:

wherein the connection protrusion is inserted into the protrusion fastening hole based on the connection protrusion being moved toward the side wall of the inner cabinet, and wherein the connection protrusion is separated from the protrusion fastening hole based on the connection protrusion being moved away from the side wall of the inner cabinet.

7. The refrigerator according to claim 5:

wherein the shelf comprises multiple shelf sections that arranged as separate shelves in a vertical direction, and wherein the protrusion fastening hole comprises multiple protrusion fastening holes located at heights corresponding to each of the multiple shelf sections.

8. The refrigerator according to claim 4:

wherein the shelf includes a protrusion fastening hole, and wherein the interlocking unit comprises a connection protrusion that is disposed on the vertical part, the connection protrusion being inserted into or separated from the protrusion fastening hole through the interlocking guide slit depending on a position of the connection protrusion.

9. The refrigerator according to claim 4, wherein the interlocking unit comprises:

a connection mount that protrudes from the vertical part toward the shelf and that is inserted into the interlocking guide slit;

a middle interlocking member that is disposed between the side wall of the inner cabinet and the shelf and that is coupled to the connection mount; and a slide interlocking member that is located on the shelf, the slide interlocking member being coupled to or separated from the middle interlocking member depending on a position of the slide interlocking member.

10. The refrigerator according to claim 9, wherein the middle interlocking member has a coupling groove and the connection mount is inserted into which the coupling groove.

11. The refrigerator according to claim 1, further comprising a frame guide disposed between the storage compartment and the horizontal plate, the frame guide being configured to support the horizontal plate and enable the horizontal plate to move forward and rearward.

12. The refrigerator according to claim 11, wherein the frame guide comprises:

a stationary rail that is fixed on the side wall of the storage compartment and that extends longitudinally in a front-rear direction of the storage compartment; and a moving rail that is fixed to the horizontal plate and that is configured to slide along the fixed rail.

13. The refrigerator according to claim 11, wherein the frame guide is a first frame guide and the refrigerator further comprises a second frame guide that is spaced apart from the first frame guide and that extends longitudinally in a front-rear direction of the storage compartment parallel to the first frame guide.

14. The refrigerator according to claim 1:

wherein the link has a front end that is connected to the door and that is configured to rotate with respect to the door; and wherein the link has a rear end that is connected to the horizontal plate and that is configured to rotate with respect to the horizontal plate.

15. The refrigerator according to claim 14, wherein the link comprises:

a first bent section that extends from the front end and that is bent convexly in a direction away from a turning axis of the door with respect to the cabinet; and a second bent section that is located between the first bent section and the rear end and that is bent convexly in a direction opposite the first bent section.

16. The refrigerator according to claim 14, wherein the rear end of the link is connected to a bottom surface of the horizontal plate.

* * * * *